US012790099B2

(12) United States Patent
Siddiqui et al.

(10) Patent No.: US 12,790,099 B2
(45) Date of Patent: Nov. 10, 2026

(54) NOZZLE INSERT FOR A DISPENSING SYSTEM

(71) Applicant: S. C. JOHNSON & SON, INC., Racine, WI (US)

(72) Inventors: Abdul Siddiqui, Sugar Land, TX (US); Tapash Deb, Mt. Pleasant, WI (US); Steven A. Zach, Waterford, WI (US)

(73) Assignee: S. C. JOHNSON & SON, INC., Racine, WI (US)

( * ) Notice: Subject to any disclaimer, the term of this patent is extended or adjusted under 35 U.S.C. 154(b) by 185 days.

(21) Appl. No.: 18/665,259

(22) Filed: May 15, 2024

(65) Prior Publication Data

US 2025/0206517 A1 Jun. 26, 2025

Related U.S. Application Data

(63) Continuation-in-part of application No. 18/395,221, filed on Dec. 22, 2023.

(51) Int. Cl.
*B65D 83/30* (2025.01)

(52) U.S. Cl.
CPC ..... *B65D 83/30* (2013.01)

(58) Field of Classification Search
CPC ..... B65D 83/30; B65D 83/141; B65D 83/28; B65D 83/753; B65D 83/206; A61L 2/22; A61L 2209/134; A61L 9/14; B05B 1/3442; B05B 1/02
See application file for complete search history.

(56) References Cited

U.S. PATENT DOCUMENTS

| | | | |
|---|---|---|---|
| 1,036,091 | A | 8/1912 | Garraway |
| 3,112,074 | A | 11/1963 | Green |
| 3,129,893 | A | 4/1964 | Green |
| 3,226,040 | A | 12/1965 | Joseph et al. |
| 3,406,911 | A | 10/1968 | Keeney |
| 3,416,737 | A | 12/1968 | Venus |
| 3,437,270 | A | 4/1969 | Venus, Jr. |

(Continued)

FOREIGN PATENT DOCUMENTS

| | | | |
|---|---|---|---|
| CN | 104027255 | B | 2/2018 |
| EP | 0805625 | B1 | 5/2000 |

(Continued)

OTHER PUBLICATIONS

Diversified CPC International, Liquefied Gas Propellant Handbook, 2010, 39 pages.

(Continued)

*Primary Examiner* — Qingzhang Zhou
(74) *Attorney, Agent, or Firm* — Quarles & Brady LLP

(57) ABSTRACT

A nozzle insert includes a body with a front portion and a rear portion, a rim, and a nozzle portion that includes an angled wall and an orifice wall. The angled wall extends radially inward and laterally forward from the rim, and the orifice wall intersects with the angled wall and defines a nozzle orifice. The orifice wall extends both laterally forward and rearward from the intersection with the angled wall. A cylindrical inner surface of the orifice wall defines a fluid passageway that terminates at a forward end at the nozzle orifice and at a rearward end spaced rearward of a forwardmost end of the angled wall.

20 Claims, 13 Drawing Sheets

(56) References Cited

U.S. PATENT DOCUMENTS 3,785,571 A 1/1974 Hoening
3,881,658 A 5/1975 Greenebaum et al.
3,994,442 A 11/1976 Hoening
4,071,196 A 1/1978 Burke et al.
4,322,037 A 3/1982 Heeb et al.
4,367,847 A 1/1983 Bayer
4,979,678 A 12/1990 Ruscitti et al.
5,137,713 A 8/1992 Dohara et al.
5,397,059 A * 3/1995 Baudin ..... B05B 7/066 222/402.18
5,540,389 A 7/1996 Knickerbocker
5,676,311 A 10/1997 Hartman
5,711,488 A 1/1998 Lund
5,738,282 A 4/1998 Grogan
5,769,325 A 6/1998 Jouillat et al.
5,783,202 A 7/1998 Tomlinson et al.
5,872,143 A 2/1999 Tanaka et al.
5,931,386 A 8/1999 Jouillat
5,992,765 A 11/1999 Smith
6,000,633 A 12/1999 Lund et al.
6,103,758 A 8/2000 Sembo
6,142,390 A 11/2000 Nordstrom et al.
6,199,766 B1 3/2001 Fox et al.
6,218,416 B1 4/2001 Sembo
6,241,165 B1 6/2001 Bickart et al.
6,279,834 B1 8/2001 Fox et al.
6,341,735 B1 1/2002 Baudin
6,418,925 B1 7/2002 Genova et al.
6,443,370 B1 9/2002 Brulle et al.
6,482,357 B1 11/2002 Fox et al.
RE38,022 E 3/2003 de Laforcade
6,533,196 B1 3/2003 Ouin et al.
6,543,703 B2 4/2003 Blake
6,551,964 B1 4/2003 Bardsley et al.
6,562,853 B2 5/2003 Mori et al.
6,609,666 B1 8/2003 Blake
6,722,585 B1 4/2004 Stradella
6,817,493 B1 11/2004 Parsons et al.
6,908,017 B2 6/2005 Mineau et al.
6,959,879 B2 11/2005 Laidler et al.
6,971,560 B1 12/2005 Healy et al.
7,004,359 B2 2/2006 Marroncles
7,036,691 B2 5/2006 Nicolas
7,143,959 B2 12/2006 Smith et al.
7,144,583 B2 12/2006 Sembo
7,204,393 B2 4/2007 Strand
7,341,736 B2 3/2008 Flashinski
7,370,815 B2 5/2008 Fecht et al.
7,478,767 B2 1/2009 Wu
7,487,891 B2 2/2009 Yerby et al.
7,530,476 B2 5/2009 Downey et al.
7,575,132 B2 8/2009 Stuart et al.
7,621,468 B2 11/2009 Smith et al.
7,748,648 B2 7/2010 Songbe et al.
7,784,650 B2 8/2010 Bates et al.
RE41,864 E 10/2010 Soule et al.
7,828,231 B2 11/2010 Harms
7,886,995 B2 2/2011 Togashi
7,922,041 B2 4/2011 Gurrisi et al.
7,938,342 B2 5/2011 Octeau et al.
7,980,491 B2 7/2011 Kakade et al.
8,100,298 B2 1/2012 Marquardt et al.
8,119,150 B2 2/2012 Tamarkin et al.
8,127,968 B2 3/2012 Yerby et al.
8,191,801 B2 6/2012 Khan et al.
8,191,802 B2 6/2012 Khan et al.
8,196,847 B2 6/2012 Helie et al.
8,276,832 B2 10/2012 Nelson et al.
8,276,835 B2 10/2012 Lowry et al.
8,313,045 B2 11/2012 Levitsky
8,333,332 B2 12/2012 Burghaus et al.
8,413,912 B2 4/2013 Songbe
8,418,892 B2 4/2013 Geier
8,418,940 B2 4/2013 Songbe et al.
8,496,137 B2 7/2013 Alfaro et al.
8,563,018 B2 10/2013 Burke
8,622,256 B2 1/2014 Campbell
8,690,081 B2 4/2014 Cornet et al.
8,741,874 B2 6/2014 Steward et al.
8,807,457 B2 8/2014 Songbe
8,844,843 B2 9/2014 Horiuchi et al.
8,870,030 B2 10/2014 Demarest et al.
8,881,944 B2 11/2014 Paas et al.
8,960,504 B2 2/2015 Benson et al.
8,967,436 B2 3/2015 Andersen et al.
8,978,937 B2 3/2015 Chambers et al.
8,985,398 B2 3/2015 Demarest et al.
9,027,854 B2 5/2015 Moser et al.
9,061,816 B2 6/2015 Best et al.
9,089,856 B2 7/2015 Gopalan et al.
9,174,229 B2 11/2015 Smith
9,205,618 B2 12/2015 Campbell et al.
9,205,973 B2 12/2015 Decea et al.
9,260,237 B1 2/2016 Brace et al.
9,265,256 B2 2/2016 Yamada et al.
9,284,112 B2 3/2016 Ghavami-Nasr et al.
9,296,549 B2 3/2016 Ghavami-Nasr et al.
9,339,030 B2 5/2016 Burke et al.
9,393,336 B2 7/2016 Ghavami-Nasr et al.
9,480,767 B1 * 11/2016 Ansley ..... A61L 9/14
9,505,546 B2 11/2016 Arora et al.
9,511,381 B2 12/2016 Takahashi
9,511,926 B2 12/2016 Arora et al.
9,527,092 B2 12/2016 Miyamoto et al.
9,555,953 B2 1/2017 Baudin
9,714,131 B2 7/2017 Arora et al.
9,802,750 B2 10/2017 Demarest et al.
9,802,751 B2 10/2017 Demarest et al.
9,821,324 B2 11/2017 Hartranft et al.
9,862,535 B2 1/2018 Christianson et al.
9,938,064 B2 4/2018 Umenaka et al.
9,938,070 B2 4/2018 Ogata et al.
9,981,799 B2 5/2018 Andersen et al.
9,999,895 B2 6/2018 Nelson et al.
10,000,330 B2 6/2018 Szekely et al.
10,112,767 B2 10/2018 Neuhalfen et al.
10,154,870 B2 12/2018 Ottanelli
10,293,356 B2 5/2019 Lee
10,414,644 B1 9/2019 Laible
10,576,702 B1 3/2020 Laible
10,577,169 B2 3/2020 Bodet et al.
10,647,501 B2 5/2020 Richard et al.
10,752,428 B2 8/2020 Das et al.
10,850,458 B1 12/2020 Laible
10,850,914 B2 12/2020 Bartolucci et al.
10,858,170 B2 12/2020 Eng et al.
11,034,507 B2 6/2021 Spang et al.
11,337,413 B2 5/2022 Spangler et al.
11,564,832 B2 1/2023 Golub et al.
11,696,577 B2 7/2023 Spangler et al.
2005/0023368 A1 2/2005 Valpey et al.
2005/0042245 A1 2/2005 Taranta et al.
2005/0234119 A1 10/2005 Soll et al.
2006/0032873 A1 2/2006 Gerondale et al.
2008/0003282 A1 1/2008 Soll et al.
2008/0038304 A1 2/2008 Nouvel
2008/0039481 A1 2/2008 Kemper et al.
2008/0093392 A1 4/2008 Abduljalil
2008/0220970 A1 9/2008 Martin et al.
2008/0227646 A1 9/2008 Martin et al.
2009/0041813 A1 2/2009 Bouillo et al.
2009/0078785 A1 3/2009 Herminghaus
2009/0118367 A1 5/2009 Steward et al.
2009/0163582 A1 6/2009 Wang et al.
2009/0218418 A1 9/2009 Sharief
2010/0048700 A1 2/2010 Davies et al.
2010/0062399 A1 3/2010 Cernohous
2010/0116909 A1 5/2010 Abduljalil
2010/0322892 A1 12/2010 Burke
2011/0303767 A1 12/2011 Smith
2012/0205466 A1 8/2012 Baltz et al.
2013/0161417 A1 6/2013 Songbe
2013/0221122 A1 * 8/2013 Ganan-Calvo ..... B65D 83/48 239/589

(56) References Cited

U.S. PATENT DOCUMENTS

| | | | |
|---|---|---|---|
| 2014/0034745 | A1 | 2/2014 | Brace et al. |
| 2014/0131398 | A1 | 5/2014 | Bardet et al. |
| 2014/0343142 | A1 | 11/2014 | Yamada |
| 2016/0100667 | A1 | 4/2016 | Aubert et al. |
| 2016/0145004 | A1 | 5/2016 | Reyes |
| 2018/0244461 | A1 | 8/2018 | Kalagher et al. |
| 2021/0315209 | A1 | 10/2021 | Harada et al. |
| 2022/0242653 | A1 | 8/2022 | Baker et al. |

FOREIGN PATENT DOCUMENTS

| | | | |
|---|---|---|---|
| EP | 0907317 | B1 | 1/2003 |
| EP | 1360014 | B1 | 5/2006 |
| EP | 3042861 | A1 | 7/2016 |
| EP | 3177405 | B1 | 5/2020 |
| EP | 3946183 | A1 | 2/2022 |
| EP | 3986801 | A1 | 4/2022 |
| JP | 2001089303 | A | 4/2001 |
| JP | 2006021107 | A | 1/2006 |
| JP | 2013124251 | A | 6/2013 |
| WO | 9601047 | A | 1/1996 |
| WO | 2005107459 | A1 | 11/2005 |
| WO | 2005107468 | A1 | 11/2005 |
| WO | 2006107905 | A1 | 10/2006 |
| WO | 2006111750 | A1 | 10/2006 |
| WO | 2007009661 | A2 | 1/2007 |
| WO | 2007112905 | A1 | 10/2007 |
| WO | 2008006464 | A1 | 1/2008 |
| WO | 2008011054 | A2 | 1/2008 |
| WO | 2008132150 | A1 | 11/2008 |
| WO | 2009013100 | A2 | 1/2009 |
| WO | 2009013247 | A2 | 1/2009 |
| WO | 2009061341 | A2 | 5/2009 |
| WO | WO-2012025735 | A1 * | 3/2012 ..... B65D 83/20 |
| WO | 2015140423 | A1 | 9/2015 |
| WO | 2015154596 | A1 | 10/2015 |
| WO | 2016080148 | A1 | 5/2016 |
| WO | 2017098210 | A1 | 6/2017 |
| WO | 2019018893 | A1 | 1/2019 |
| WO | 2020011799 | A1 | 1/2020 |
| WO | 2020046934 | A1 | 3/2020 |
| WO | 2020068696 | A1 | 4/2020 |
| WO | 2020162951 | A1 | 8/2020 |
| WO | 2020198655 | A1 | 10/2020 |
| WO | 2020219086 | A1 | 10/2020 |
| WO | 2020227308 | A1 | 11/2020 |
| WO | 2021050318 | A1 | 3/2021 |
| WO | 2021076725 | A1 | 4/2021 |
| WO | 2022165337 | A1 | 8/2022 |
| WO | 2024156590 | A1 | 8/2024 |

OTHER PUBLICATIONS

PCT International Search Report and Written Opinion, PCT/US2024/060023, Apr. 22, 2025, 16 pages.

PCT International Search Report and Written Opinion, PCT/US2024/059987, Apr. 2, 2025, 16 pages.

* cited by examiner

NOZZLE INSERT FOR A DISPENSING SYSTEM

CROSS REFERENCE TO RELATED APPLICATIONS

This application is a continuation-in-part of U.S. patent application Ser. No. 18/395,221, filed on Dec. 22, 2023, which is incorporated by reference herein in its entirety.

REFERENCE REGARDING FEDERALLY SPONSORED RESEARCH OR DEVELOPMENT

Not applicable

SEQUENTIAL LISTING

Not applicable

BACKGROUND OF THE DISCLOSURE

1. Field of the Disclosure

The present disclosure relates generally to dispensing systems including an actuator assembly for placement on a container, and in particular, a nozzle insert for a product dispensing system having an actuator.

2. Description of the Background of the Disclosure

Pressurized and non-pressurized containers are commonly used to store and dispense product that includes fluids and other materials, such as air fresheners, deodorants, insecticides, germicides, decongestants, perfumes, and the like. In some cases, materials can be stored in a pressurized and liquefied state within the container and can be forced from the container by a propellant (e.g., a hydrocarbon or non-hydrocarbon). In some cases, a release valve with an outwardly extending valve stem may be provided to facilitate the release of the volatile material from the container, whereby activation of the valve via the valve stem causes volatile material to flow from the container through the valve stem. The release valve may be activated by tilting, depressing, or otherwise displacing the valve stem.

In some cases, nozzle assemblies for containers (e.g., as included on a larger actuator assembly) can include a nozzle insert and a corresponding nozzle-insert cavity to form a combined nozzle assembly that can provide a desired flow characteristic (e.g., spray pattern, flow rate, metering effect, and so on). Due to different manufacturing tolerances and errors (e.g., error in pressures applied by assembly machines), as well as user interactions, the nozzle inserts and/or nozzle-insert cavities can sometimes be over-compressed during assembly or at other times. In some cases, this can result in degradation of the dispensing capabilities of the nozzle assembly as a whole.

The present disclosure relates generally to dispensing systems and, more specifically, to a product dispensing system having an actuator with a nozzle insert that addresses one or more aspects of prior art dispensing systems.

SUMMARY OF THE DISCLOSURE

According to some aspects of the disclosure, a dispensing system contains a composition consisting of one or more of a deodorizing composition, a fragrancing composition, a cleaning composition, or a composition of the like. Further, the dispensing system includes a nozzle insert. The nozzle insert includes a body with a front portion and a rear portion, a rim, and a nozzle portion that includes an angled wall and an orifice wall. The angled wall extends radially inward and laterally forward from the rim, and the orifice wall intersects with the angled wall and defines a nozzle orifice. Further, the orifice wall extends both laterally forward and rearward from the intersection with the angled wall, and a cylindrical inner surface of the orifice wall defines a fluid passageway that terminates at a forward end at the nozzle orifice and at a rearward end spaced rearward of a forwardmost end of the angled wall.

In some embodiments, a dispensing system contains a composition consisting of one or more of a deodorizing composition, a fragrancing composition, a cleaning composition, or a composition of the like. Further, the dispensing system includes a nozzle insert, which includes a body comprising a front portion and a rear portion, a rim, and a nozzle portion that includes an angled wall and an orifice wall. The orifice wall intersects with the angled wall and defines a nozzle orifice. The orifice wall extends both laterally forward and rearward from the intersection with the angled wall, creating a gap between the angled wall and the orifice wall. Additionally, a cylindrical inner surface of the orifice wall defines a fluid passageway that terminates at a forward end at the nozzle orifice and at a rearward end spaced rearward of a forwardmost end of the angled wall.

In some embodiments, a dispensing system contains a composition consisting of one or more of a deodorizing composition, a fragrancing composition, a cleaning composition, or a composition of the like. Further, the dispensing system includes a nozzle insert. The nozzle insert includes a body comprising a front portion and a rear portion, a rim, a nozzle portion that includes an angled wall and an orifice wall, and a plurality of raised portions located on an interior surface of the rim. The orifice wall intersects with the angled wall, defines a nozzle orifice, and extends both laterally forward and rearward from the intersection with the angled wall. A cylindrical surface of the orifice wall defines a fluid passageway that terminates at a forward end at the nozzle orifice and at a rearward end spaced rearward of a forwardmost end of the angled wall.

In some embodiments, the nozzle insert is configured to fit over a post of an external actuator. Further, in some embodiments, an interior cavity of the nozzle insert is defined by an interior surface of the body, an interior surface of the rim, and an interior surface of the angled wall. The interior cavity and the outlet channel further define a fluid passageway and a central axis. The fluid passageway defines a flow path that is generally parallel with respect to the central axis. In some embodiments, the rim further comprises a rim front surface and a radially central wall. In some embodiments, the radially central wall extends laterally forward from the rim front surface. Some embodiments of the nozzle insert include a plurality of ribs that are located on the interior surface of the body and that extend axially toward an interior cavity of the nozzle insert. In some embodiments, the raised portions each include a stop portion that is defined as a flat upstream face extending radially inward from the interior surface of the rim. In some embodiments, the gap between the angled wall and the orifice wall acts as a swirl chamber and is generally frustoconical in shape. In some embodiments, the orifice wall extends laterally rearward from the forwardmost point of the gap. Some embodiments of the nozzle insert include a plurality of cavities that extend radially inward from an exterior surface of the angled wall. In some embodiments, the orifice wall is cylindrical in shape, and a forwardmost face of the orifice wall defines a flat front face of the nozzle insert. In some embodiments, the nozzle insert further includes a nozzle insert cavity that is defined in part by the body of the nozzle insert. In some embodiments, the nozzle insert is configured to attach to a container including a composition. In some embodiments, at a first time, the nozzle insert cavity is primarily filled with the composition in a gaseous or substantially gaseous state, and at a second time, the nozzle insert cavity is primarily filled with the composition in a liquid or substantially liquid state. In some embodiments, the first time occurs before the second time.

In some embodiments, the raised portions comprise a plurality of sloped portions and a level portion. The level portion is disposed between the plurality of sloped portions. Further, in some embodiments an opening is disposed between the raised portions, and the opening may further define the fluid passageway to the outlet channel or to the gap between the angled wall and the orifice wall.

DETAILED DESCRIPTION OF THE DRAWINGS

Figure 1:
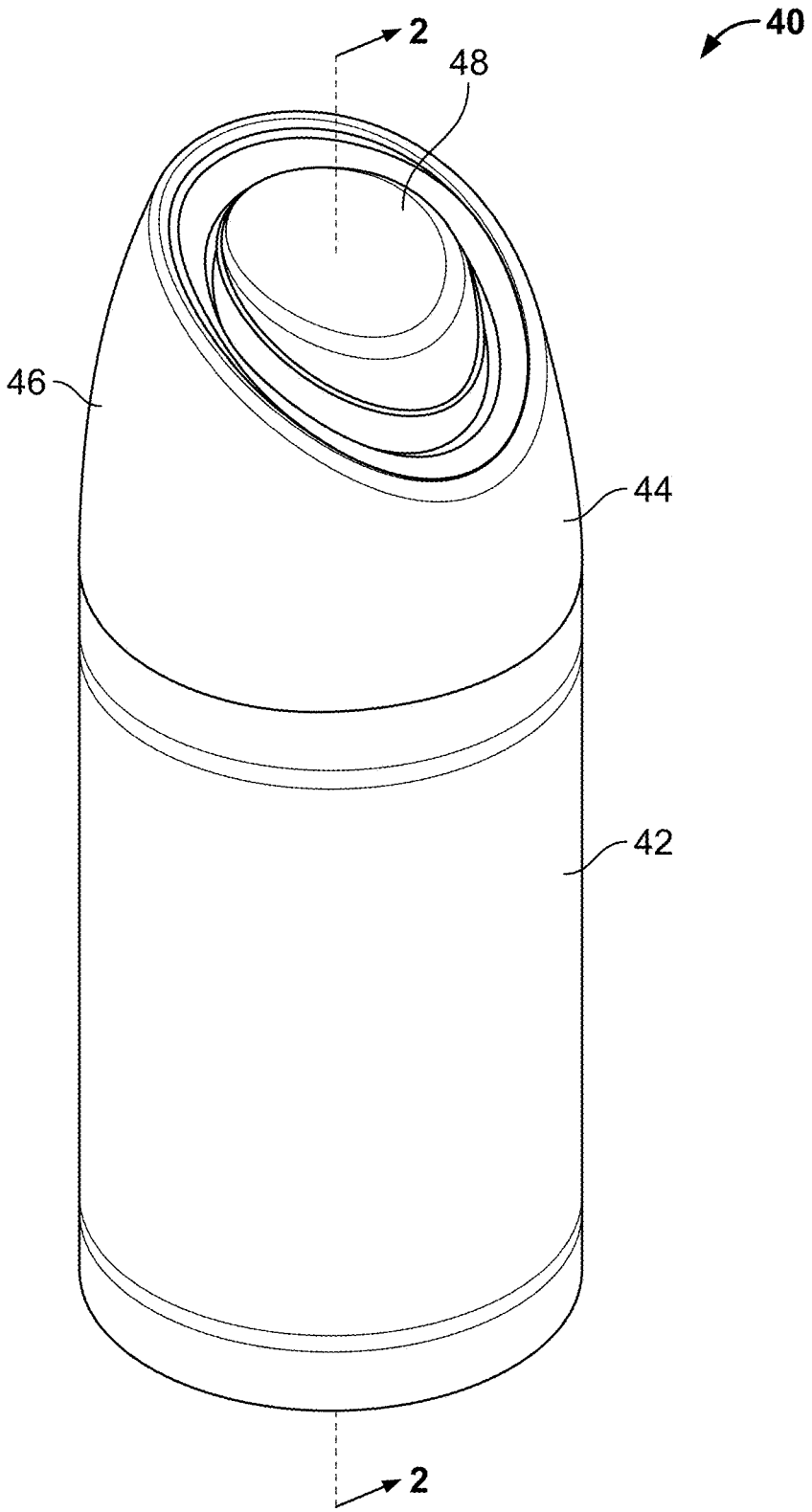
FIG. 1 is a rear isometric view of a product dispensing system that includes a container and an actuator assembly attached thereto.

The present disclosure provides for a nozzle insert for an actuator assembly, which can be used with a product dispensing system to dispense a product from a container through the actuator assembly. Some embodiments can include an actuator and a nozzle insert configured to be inserted into the actuator during assembly, with the actuator including a stop portion arranged to interact with the nozzle insert. While the embodiments disclosed herein depict a push-button actuator, any type of known actuator is contemplated, including trigger-type actuators, i.e., for trigger sprayers. The use herein of the terms "downstream" and "upstream" generally indicate direction relative to the flow of a fluid. In this regard, the term "downstream" corresponds to the direction of a relevant fluid flow, while the term "upstream" refers to the direction opposite or against the direction of the relevant fluid flow.

The use herein of the term "axial" and variations thereof refer to a direction that extends generally along an axis of symmetry, a central axis, or an elongate direction of a particular component or system. For example, axially extending features of a component may be features that extend generally along a direction that is parallel to an axis of symmetry or an elongate direction of that component. Similarly, the use herein of the term "radial" and variations thereof refers to directions that are generally perpendicular to a corresponding axial direction. For example, a radially extending structure of a component may generally extend at least partly along a direction that is perpendicular to a longitudinal or central axis of that component. While the methods and systems disclosed herein may be embodied in many different forms, several specific embodiments are discussed herein with the understanding that the embodiments described in the present disclosure are to be considered only exemplifications of the principles described herein, and the disclosure is not intended to be limited to the embodiments illustrated. Throughout the disclosure, the terms "about" and "approximately" mean plus or minus 5% of the number or value that each term precedes.

The term "substantially," as used herein, may mean at least about 80%, preferably at least about 90%, more preferably at least about 99%, for example at least about 99.9%. In some embodiments, the term "substantially" can mean completely, or about 100%.

The term "weight percent", "wt. %", "wt. %," "percent by weight", "% by weight", and variations thereof, as used herein, refer to the concentration of a substance as the weight of that substance divided by the total weight of the composition and multiplied by 100. It is understood that, as used here, "percent", "%", and the like may be synonymous with "weight percent", "wt. %", etc.

As used herein, "pests" can mean any organism whose existence it can be desirable to control. Pests can include, for example, bacteria, cestodes, fungi, insects, nematodes, parasites, plants, and the like. In addition, as used herein, "pesticidal" can mean, for example, antibacterial, antifungal, antiparasitic, herbicidal, insecticidal, and the like.

More so, for purposes of simplicity, the term "insect" is used in this application. However, it should be understood that the term "insect" refers, not only to insects, but may also refer to mites, spiders, and other arachnids, larvae, and like invertebrates. As used herein, the term "insect" refers to and includes but is not limited to insects or arachnids capable of acting as vectors for disease to humans, animals, birds, fish, plants or plant parts, or capable of irritating or causing economic damage thereto. Examples include but are not limited to nematodes, biting insects (such as mosquitoes, gnats, horse flies, ticks, tsetse flies, blowflies, screw flies, bed bugs, fleas, lice and sea lice), sap-sucking insects (such as aphids and *thrips*), and further include arachnids, ticks, termites, silverfish, ants, cockroaches, locusts, fruit flies, wasps, hornets, yellow jackets, scorpions, chiggers, and mites (such as dust mites).

Referring now to FIG. 1, a product dispensing system 40 is illustrated, which is configured to store and/or dispense an aerosol product or compressed gas (not shown). The dispensing system 40 includes a container 42 and an actuator assembly 44, which includes a housing 46, an actuator 48, and a nozzle insert 50 (see FIG. 2). In use, the actuator assembly 44 is configured to release the product from the container 42 upon the occurrence of a particular condition. For example, a user of the product dispensing system 40 may manually depress or otherwise activate the actuator 48 of the actuator assembly 44 to release the aerosol or compressed gas from the container 42. While the present embodiment depicts a push button actuator assembly 44, other types of actuator assemblies are contemplated for use with the nozzle insert 50, including trigger-type actuator assemblies.

In general, the product to be dispensed may be any solid, liquid, or gas (or a combination thereof) that is known to those skilled in the art as being capable of being dispensed from a container. In some embodiments, for example, the container 42 may contain any type of pressurized or non-pressurized product, such as compressed gas that may be liquified, non-liquified, or dissolved, including carbon dioxide, helium, hydrogen, neon, oxygen, xenon, nitrous oxide, or nitrogen. In some embodiments, the container 42 contains any type of hydrocarbon gas, including acetylene, methane, propane, butane, isobutene, halogenated hydrocarbons, ethers, mixtures of butane and propane, otherwise known as liquid petroleum gas or LPG, and/or mixtures thereof. In some cases, the product discharged may be a fragrance or insecticide disposed within a carrier liquid, a deodorizing liquid, or the like. In some cases, the product may also include other actives, such as sanitizers, air fresheners, cleaners, odor eliminators, mold or mildew inhibitors, insect repellents, and/or the like, and/or may have aromatherapeutic properties. The product dispensing system 40 is therefore adapted to dispense any number of different products.

Figure 2:
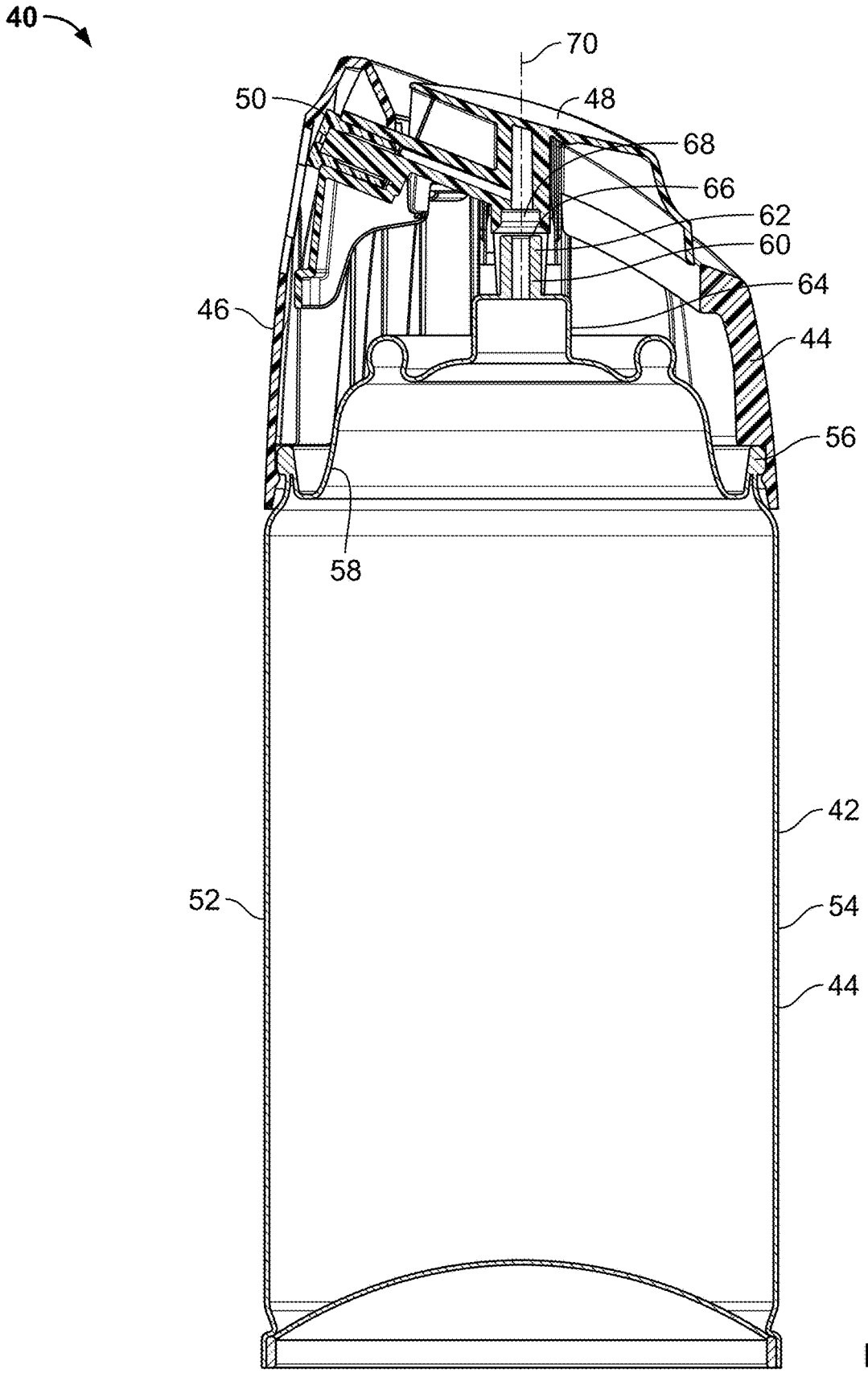
FIG. 2 is a cross-sectional view of the product dispensing system taken through line 2-2 of FIG. 1.

Referring to FIG. 2, the container 42 comprises a substantially cylindrical body 52 defining an outer sidewall 54. Further, a seam 56 and/or mounting cup 58 provide a location in which the actuator assembly 44 may be attached, as is known in the art. A conventional valve assembly 60 is shown, which includes a valve stem 62, which is connected to a valve body (not shown) and a valve spring (not shown) disposed within the container 42. The valve stem 62 extends upwardly through a pedestal 64, such that a distal end 66 extends upwardly, away from the pedestal 64 and is adapted to interact with a valve seat 68 disposed within the actuator 48. A longitudinal axis 70 extends through the valve stem 62. Prior to use, the actuator 48 is placed in fluid communication with the distal end 66 of the valve stem 62. A user may manually or automatically operate the actuator 48 to open the valve assembly 60, which causes a pressure differential between the container interior and the atmosphere to force the contents out of the container 42, through the valve stem 62 and the actuator assembly 44, and into the atmosphere. Further, while the valve stem 62 is shown as a unitary component with the container 42, the valve stem 62 may be provided in a variety of configurations and is provided for illustrative purposes only. U.S. Patent Publication No. 2022/0402685 discloses an aerosol dispensing system similar to the system shown in FIGS. 1 and 2, and is herein incorporated by reference in its entirety.

Figure 3:
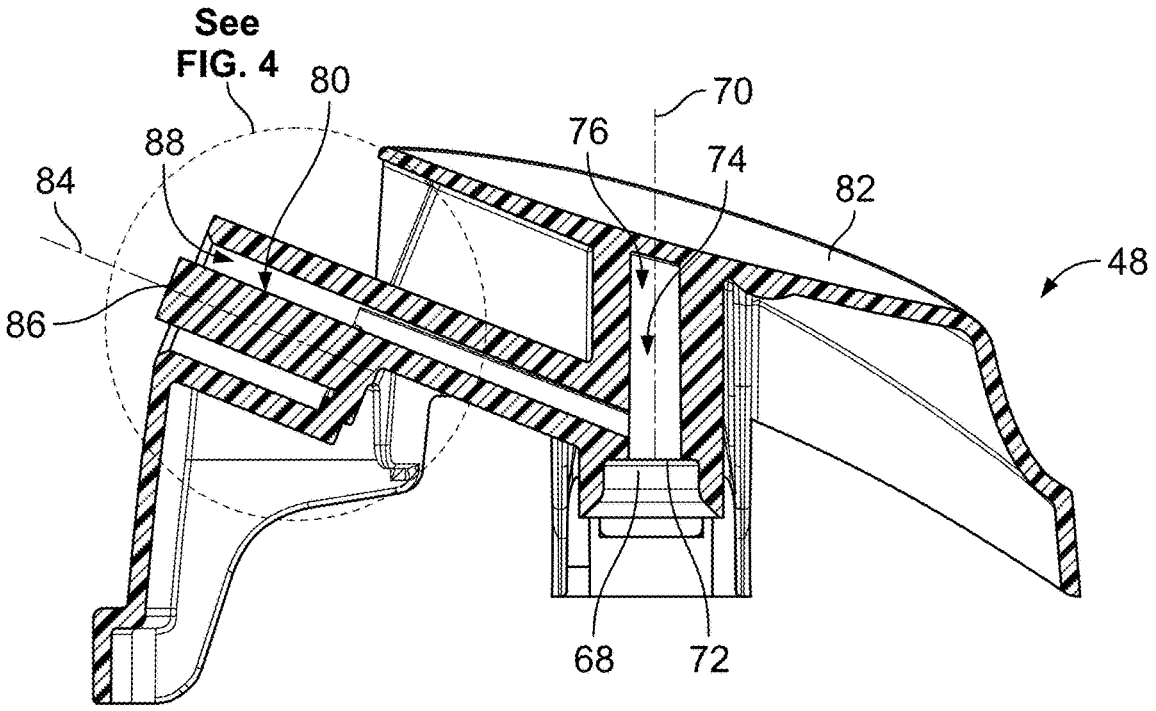
FIG. 3 is a side cross-sectional view of the actuator assembly of FIG. 2.

Referring now to FIG. 3, a cross-sectional view of the actuator 48 is shown in greater detail. The valve seat 68, an upper surface 72 of the valve seat 68, an actuator fluid passageway 74 including a vertical conduit 76, a nozzle conduit 80 that may be angled with respect to the vertical conduit 76, and a top wall 82 are also shown in detail. A spray axis 84 is also shown in the depicted embodiment, which is generally centrally located within a post 86 and is arranged at an offset angle with respect to the longitudinal axis 70. The post 86 is disposed within the nozzle insert 50 and further defines the actuator fluid passageway 74. The actuator 48 is provided for illustrative purposes only and may be provided in a variety of configurations.

Figure 4:
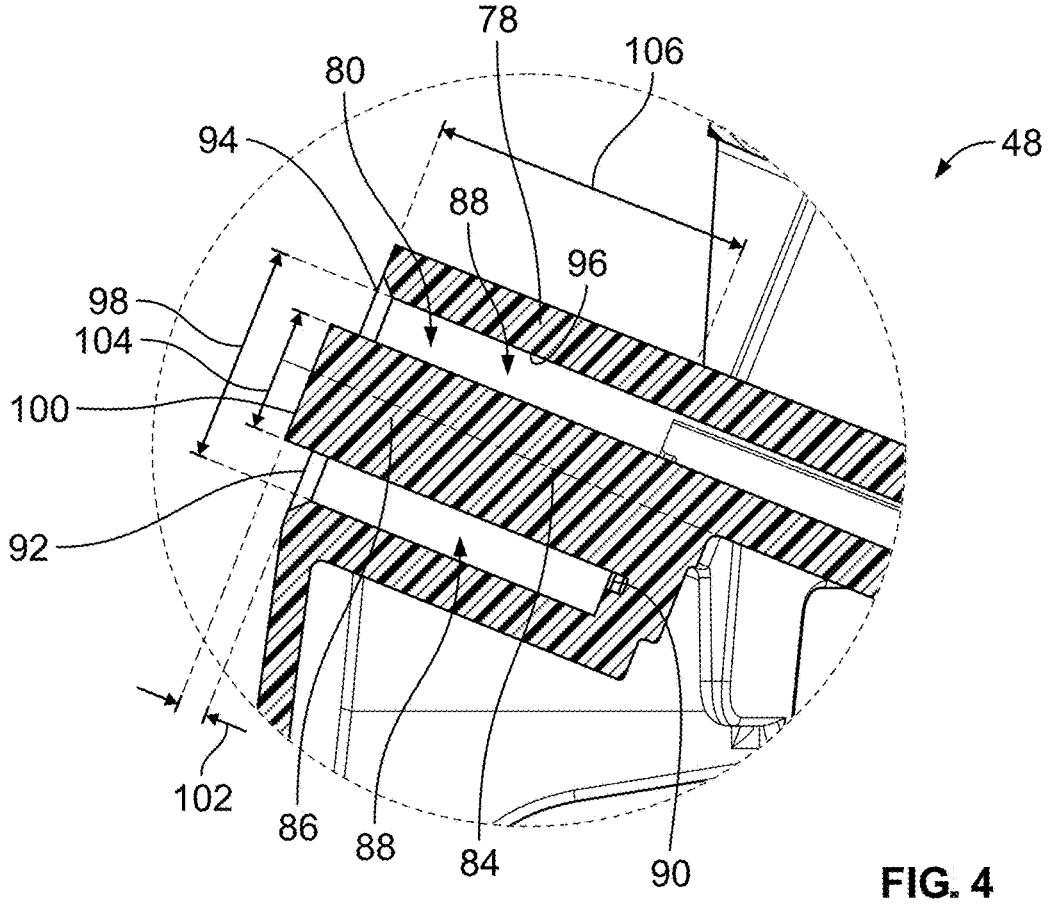
FIG. 4 is a detail, cross-sectional view of a nozzle end of the actuator of FIG. 3.

Referring now to FIG. 4, the actuator 48 includes the nozzle conduit 80, which is configured to receive the nozzle insert 50. In the illustrated embodiment, the nozzle conduit 80 defines a generally cylindrical annular nozzle-insert cavity 88 that extends generally along the spray axis 84, from an actuator stop portion 90 to an open end 92. Further, the open end 92 includes a chamfered surface 94 that is configured to guide the nozzle insert 50 into a nozzle-insert cavity 88 during assembly. For the description herein of features relating to or included within the nozzle insert 50 and nozzle-insert cavity 88, the use of the terms "axial," "radial," and "circumferential" (and variations thereof) are based on a reference axis corresponding to a spray axis 84. In this regard, for example, the nozzle-insert cavity 88 includes a radially outer surface 96 that extends as a generally circumferential barrel around the nozzle-insert cavity 88 and defines an outer diameter 98 thereof. Similarly, the post 86 within the nozzle-insert cavity 88 extends generally axially from a base near the stop portion 90 to a distal end 100 of the post 86 spaced from the open end 92 of the nozzle-insert cavity 88 by a distance 102. The post 86 further defines a post diameter 104, and the insert cavity 88 is further defined by an insert cavity length 106.

In general, the shape and profile defined by the post 86 and by the nozzle-insert cavity 88 are configured to conform generally to one or more portions of the nozzle insert 50, to facilitate receipt and retention of the nozzle insert 50 within the nozzle-insert cavity 88. In the illustrated embodiment, for example, the post 86 and the nozzle-insert cavity 88 define generally cylindrical shapes configured to engage corresponding cylindrical (or other) features on the nozzle insert 50.

Referring now to FIGS. 5-17, the nozzle insert 50 is shown in greater detail. The nozzle insert 50 is configured to be inserted at least partially into the nozzle-insert cavity 88 and to thereby promote the dispensing of the product within the container 42 to the surroundings with desirable fluid flow characteristics. In some embodiments, the nozzle insert 50 may be fabricated from a plastic material. In some embodiments, for example, the nozzle insert 50 may be fabricated from an acetal, i.e., polyoxymethylene, material. In some embodiments, for example, the nozzle insert 50 may be fabricated from polypropylene, propylene, HDPE, nylon, or other co- or homopolymers.

Figure 5:
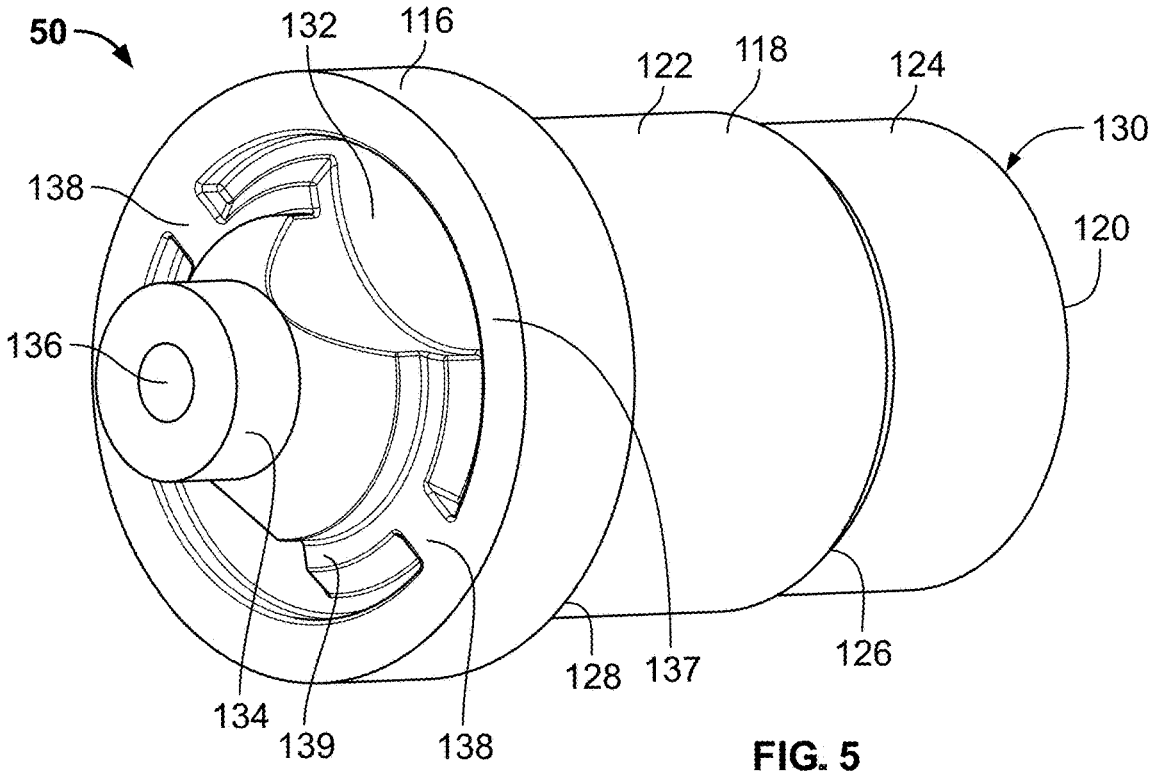
FIG. 5 is a front isometric view of a nozzle insert of the actuator assembly of FIG. 2.
Figure 6:
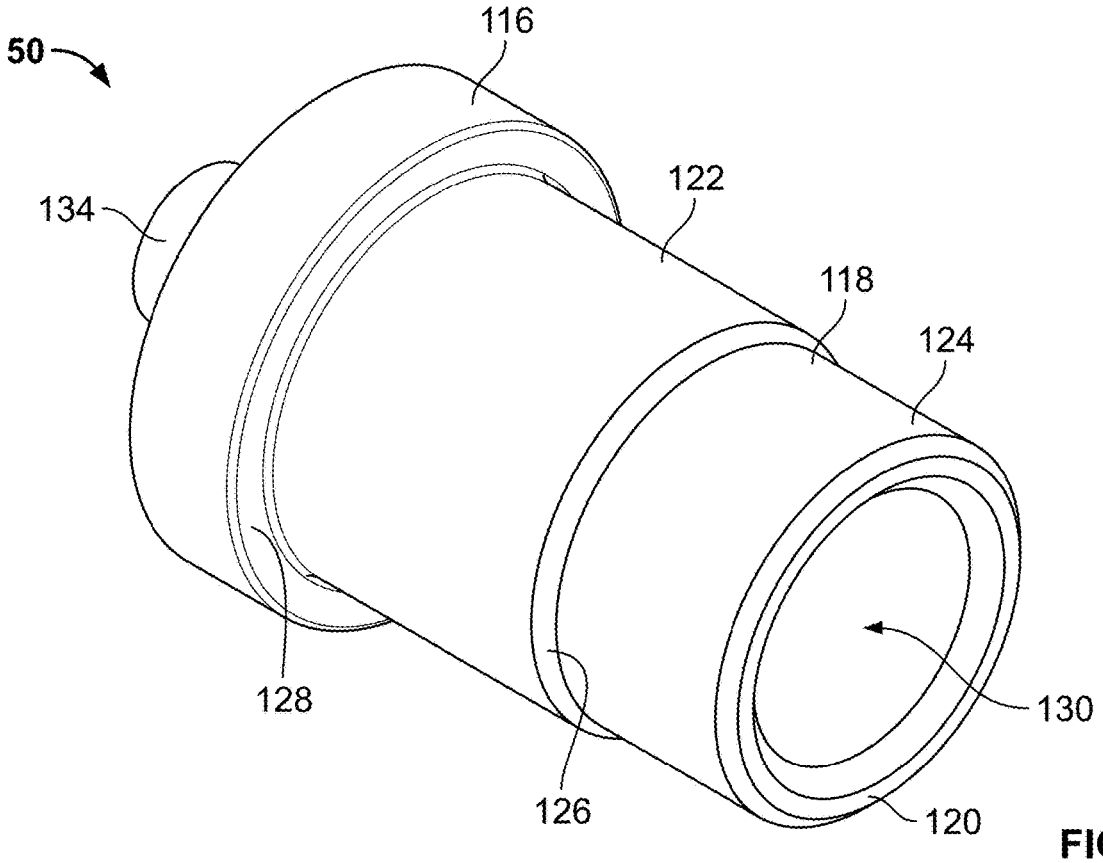
FIG. 6 is a rear isometric view of the nozzle insert of FIG. 5.

As illustrated in FIGS. 5 and 6, the nozzle insert 50 includes a nozzle rim 116 and a nozzle body 118 that extends from the nozzle rim 116. The nozzle body 118 defines a generally annular cylinder extending generally axially between the nozzle rim 116 and a generally open insert inlet end 120. The nozzle body 118 defines a front or first portion 122 and a rear or second portion 124 that are separated by a first or chamfered step 126. The nozzle rim 116 and the nozzle body 118 are connected at a second step 128. The inlet end 120 of the nozzle insert 50 can provide access to a nozzle interior cavity 130 (see FIG. 6), to enable the post 86 to be slidably received within the interior cavity 130. The nozzle rim 116 further defines a nozzle front surface or rim front surface 132. The rim front surface 132 is defined as the surface of the rim 116 on the side of the rim 116 opposite the nozzle body 118. A nozzle front portion 134 extends from the rim 116 in the opposite direction of the nozzle body 118. The nozzle portion 134 defines a nozzle orifice 136.

Referring now to FIG. 5, the nozzle rim 116 includes the rim front surface 132, a radially outer wall 137, a plurality of struts 138, and a radially central wall 139. The radially outer wall 137 is a wall that extends in the opposite direction of the nozzle body 118. The radially outer wall 137 may be provided along the circumference of the rim front surface 132. The plurality of struts 138 may extend between the radially outer wall 137 and the radially central wall 139. The plurality of struts 138 may have a thickness substantially equivalent to the thickness of the radially outer wall 137. The radially central wall 139 may also have a thickness substantially equivalent to the thickness of the radially outer wall 137 and the plurality of struts 138. The radially central wall 139 may be located at the radial center of the rim front surface 132. The radially central wall 139 may include two convex and two concave sides forming an irregular, but symmetrical shape. The nozzle front portion 134 may extend from the radially central wall 139 in the opposite direction of the nozzle body 118. In some embodiments, the struts 138 may be rectangular, triangular, or any other shape. Further, the struts 138 may be irregularly shaped. In some embodiments, the struts 138 may not have a consistent thickness.

Figure 7:
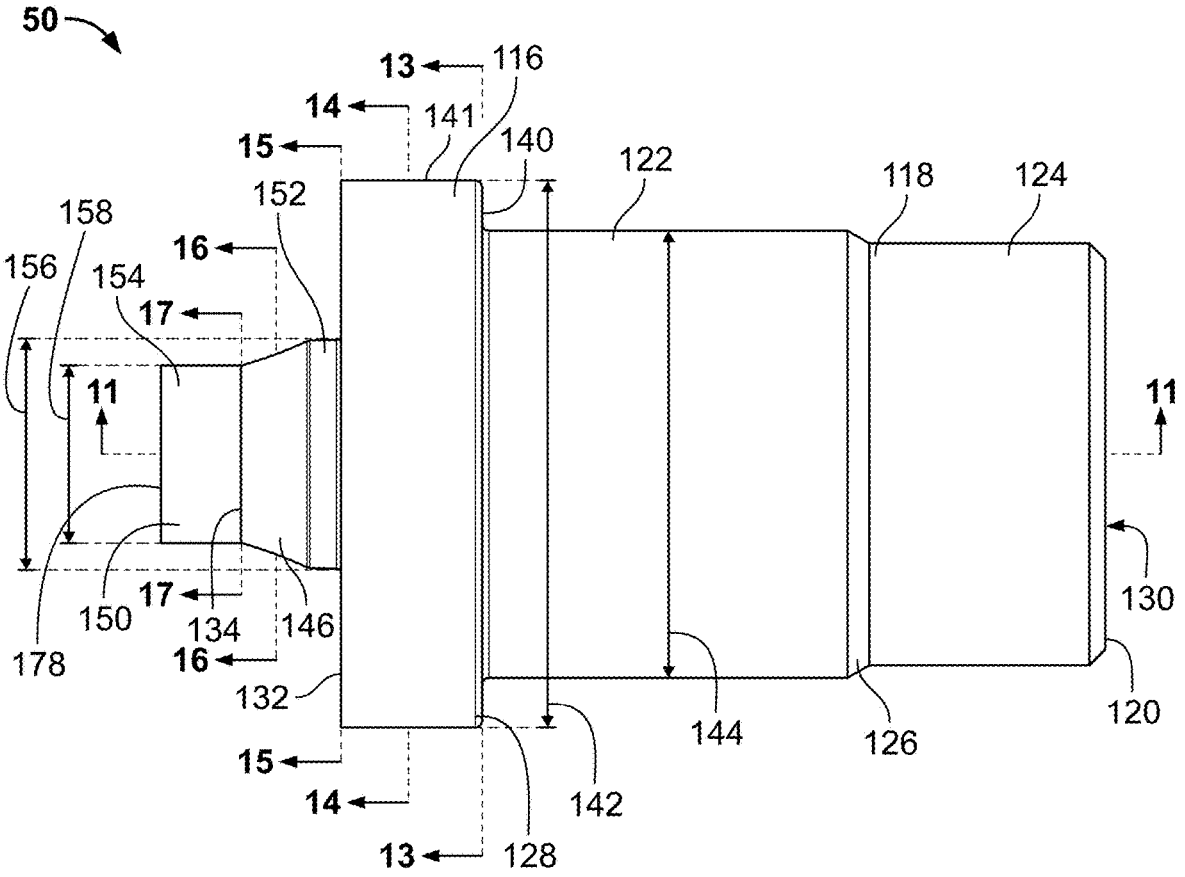
FIG. 7 is a side elevational view of the nozzle insert of FIG. 5.

Referring to FIG. 7, the nozzle body 118 defines the first portion 122 and the second portion 124, which are separated from one another by the chamfered step 126. In general, the stepped profile of the nozzle body 118 is designed to interact with the nozzle-insert cavity 88 of the actuator 48 to provide engagement and to impede over-insertion of the nozzle body 118 into the nozzle-insert cavity 88. In the illustrated embodiment, for example, the nozzle rim 116 of the nozzle insert 50 includes a stepped configuration defining a first insert stop surface 140, which defines a radially extending surface. The first insert stop surface 140 extends generally radially inward between a rim outer surface 141, which defines a rim diameter 142, and an exterior surface of the first portion 122, which defines the first portion diameter 144. An exterior surface of the second portion 124 is further stepped inward via the chamfered step 126.

Still referring to FIG. 7, the nozzle portion 134 includes a first nozzle portion 152, an angled wall 146, and a second nozzle portion 154. The angled wall 146 extends laterally outward and radially inward to form a chamfered step between the first nozzle portion 152 and the second nozzle portion 154. The first nozzle portion 152 defines a first nozzle portion diameter 156, and the second nozzle portion 154 defines a second nozzle portion diameter 158. The first nozzle portion diameter 156 is larger than the second nozzle portion diameter 158. The nozzle portion 134 is generally annular cylindrical and extends generally axially from the nozzle rim 116. The nozzle rim 116 and the nozzle portion 134 are connected at the radially central wall 139 of the rim 116. In the illustrated embodiment, the nozzle portion 134 extends perpendicularly from the radially central wall 139. In further embodiments, a step (not pictured) may connect the nozzle portion 134 and the radially central wall 139.

Figure 8:
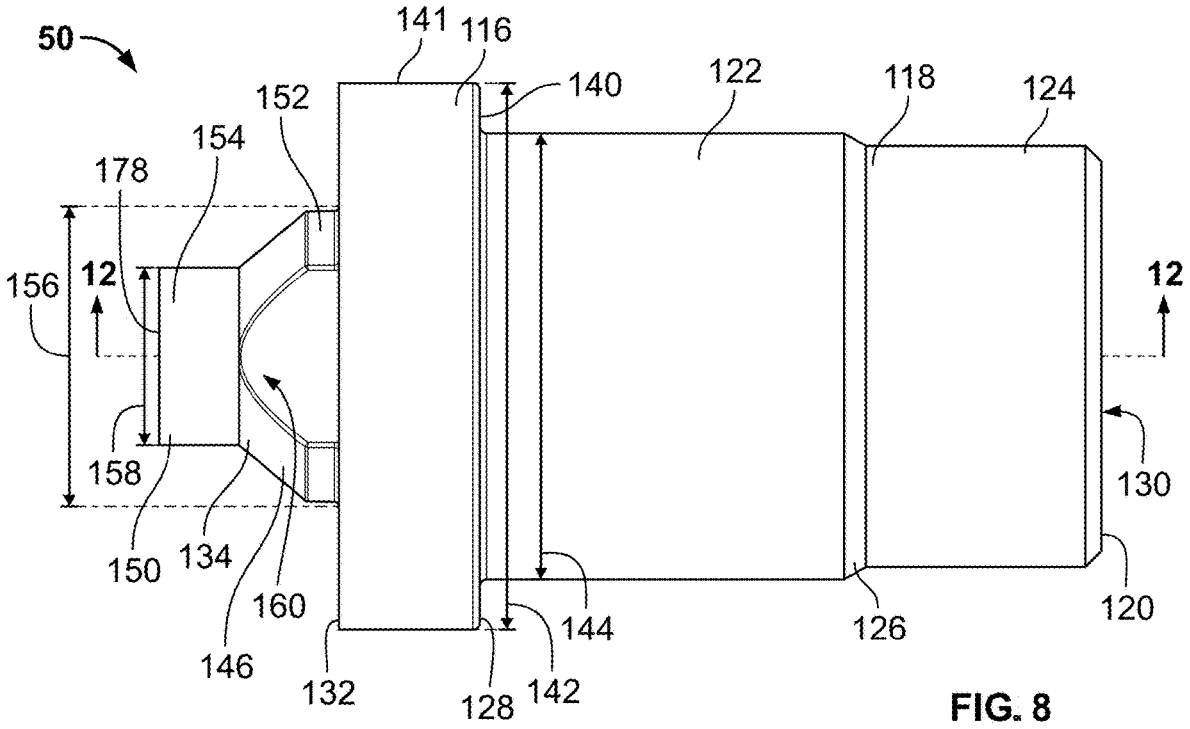
FIG. 8 is a top plan view of the nozzle insert of FIG. 5, the bottom plan view being identical thereto.
Figure 9:
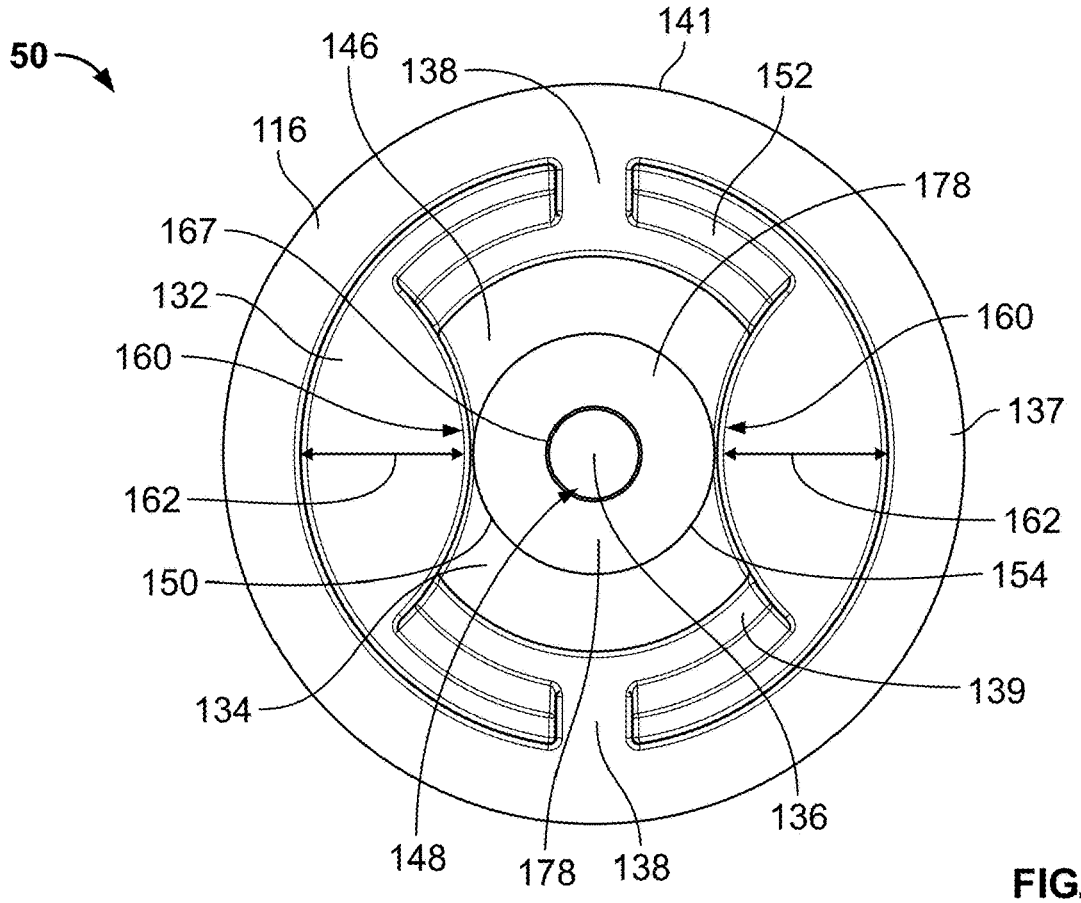
FIG. 9 is a front elevational view of the nozzle insert of FIG. 5.

As shown in FIGS. 8 and 9, the top and bottom of the nozzle portion 134 include cavities 160 that are defined by circular cutouts (see, e.g., FIG. 5). The cutouts defining the cavities 160 may be elliptical in shape, or the cutouts defining the cavities 160 may be rectangular, circular, or any other shape known in the art. The cavities 160 define depression depths 162 (see FIG. 9). In some embodiments, the depression depths 162 of the cavities 160 may be equivalent or substantially the same. However, in other embodiments, the depression depths 162 may differ. Further, in some embodiments, the depression depths 162 may be any value between zero and the difference between the first nozzle portion diameter 156 and the second nozzle portion diameter 158.

Referring now to FIG. 9, the nozzle orifice 136 is located concentric with respect to the second nozzle portion 154, and is defined by the end of an outlet channel 148. As previously mentioned, the radially central wall 139 includes two outer convex sides and two outer concave sides. The convex sides are separated by the concave sides, forming a generally four-sided symmetrical shape. In some embodiments, the radially central wall 139 may be a different shape, including a circle, oval, square, or a different irregular shape. The radially central wall 139 may be centered around the radial center of the rim 116.

Figure 10:
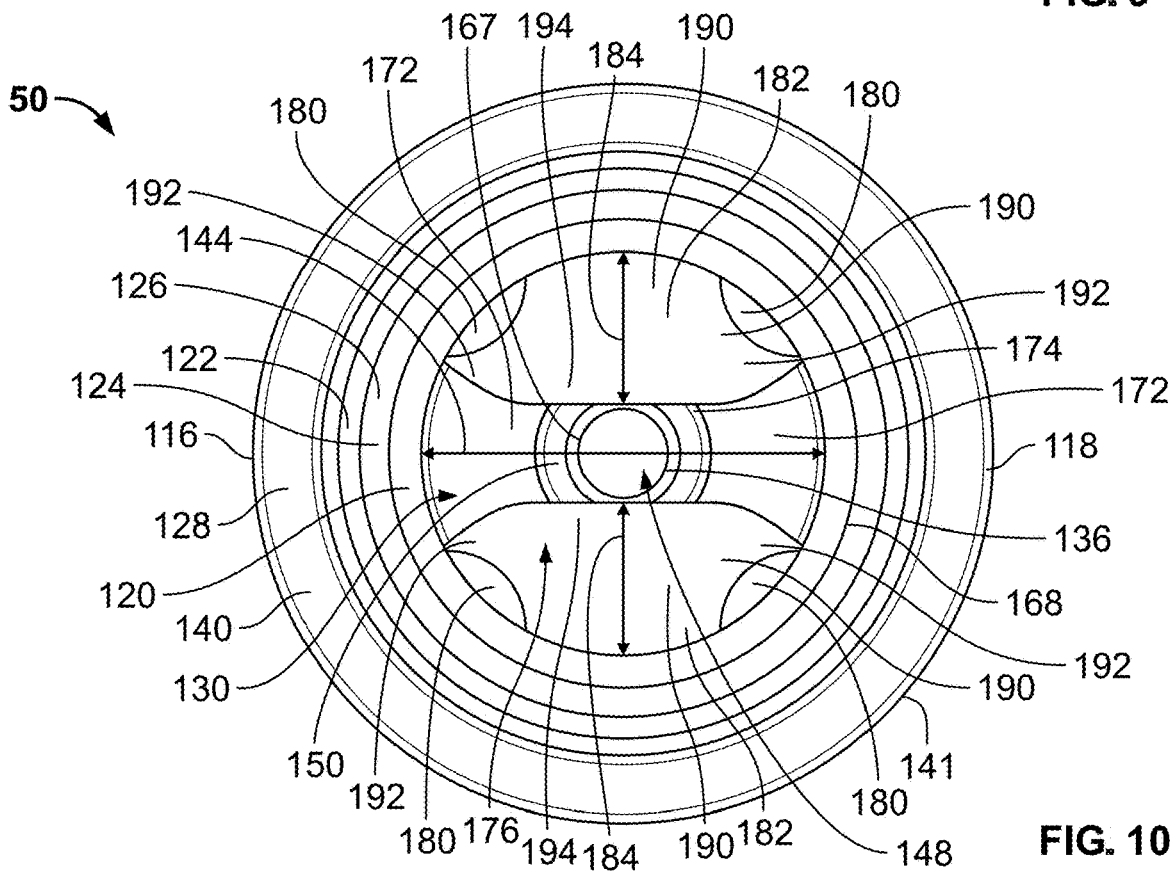
FIG. 10 is a rear elevational view of the nozzle insert of FIG. 5.

Referring to FIG. 10, the nozzle interior cavity 130 is shown in detail, which may be configured to receive the post 86. An inner surface 170 of the rim 116, an inner surface of the first portion 122, and an inner surface of the second portion 124 define an interior surface 168 of the nozzle body 118. The interior surface 168 defines an inner body that is generally cylindrical and follows the steps 126, 128 of the outside of the nozzle body 118. The interior cavity 130 may include a plurality of ribs 180 that extend generally radially inward from the interior surface 168 of the nozzle body 118, resulting in local deviations from the nozzle interior cavity 130 diameter, along the ribs 180. In the embodiment illustrated, the nozzle insert 50 includes four ribs 180 arranged circumferentially around the interior surface 168 in approximately ninety-degree increments. In other embodiments, for example, the nozzle insert 50 may include more or fewer ribs, or may include flats, any of which may be arranged circumferentially around the interior surface 168 in any increment, as desired. The ribs 180 are configured to engage a post 86 of the actuator 48 to center, or otherwise align, and secure the nozzle insert 50 within the nozzle-insert cavity 88.

As shown in FIG. 10, the nozzle interior cavity 130 also includes a plurality of raised portions 182. The raised portions 182 extend radially inward. The maximum amount that the raised portions 182 extend radially inward defines a maximum height 184. In some embodiments, the maximum height 184 is substantially the same as the difference between a radius of the nozzle interior cavity 130 and a radius of the outer surface of the orifice wall 150. As a result, the most radially-interior surface of the raised portions 182 is even with the outlet channel 148. In the illustrated example, the nozzle insert 50 includes two opposing raised portions 182 that are arranged circumferentially around the interior surface 170 of the rim 116 in approximately one-hundred-and-eighty-degree increments. The illustrated raised portions 182 each include a second insert stop surface 190 that is defined by a flat face (see FIG. 11) on the upstream end of the raised portions 182.

Figure 11:
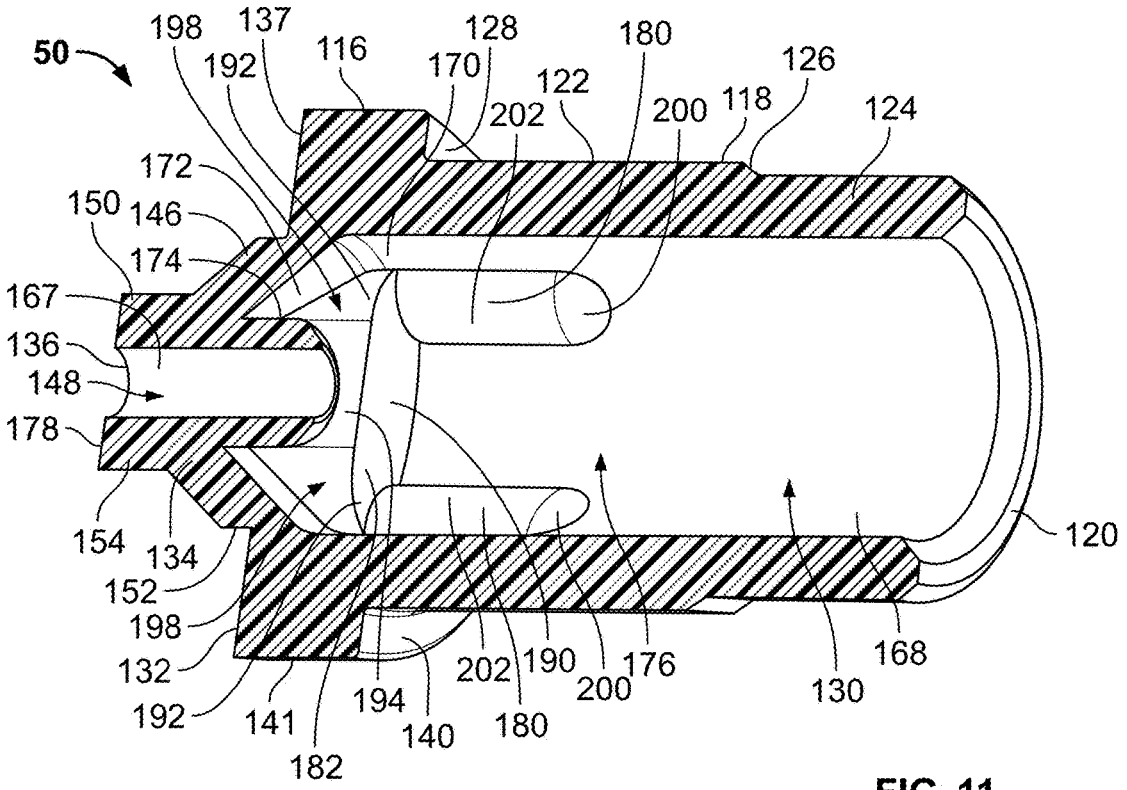
FIG. 11 is a side cross-sectional view of the nozzle insert taken through line 11-11 of FIG. 7.

Referring to FIGS. 10 and 11, the raised portions 182 extend radially inward from the interior surface 170 of the rim 116. The raised portions 182 also include a plurality of sloped portions 192, and a level portion 194 disposed between the sloped portions 192. The raised portions 182 intersect the interior surface 170 (see FIG. 11) of the rim 116 at an oblique angle. The raised portions 182 also intersect an interior surface 172 of the angled wall 146 at an oblique angle. Further, the raised portions 182 intersect a second surface 174 of the orifice wall 150 at a right angle. In other embodiments, for example, the nozzle insert 50 may include more or fewer raised portions or may include no raised portions. In some embodiments, the raised portions 182 may be disposed along the interior surface 168 of the nozzle body 118. The second insert stop surface 190 of the raised portions 182 may prevent over insertion of the nozzle insert 50 into the nozzle-insert cavity 88.

As shown in FIG. 11, the outlet channel 148 is defined by a first surface 167 of the orifice wall 150. In the present disclosure, the orifice wall 150 has a non-zero, constant thickness resulting in a front face 178 of the nozzle portion 134 that is parallel with respect to the rim front surface 132. In other embodiments, the orifice wall 150 may taper into a zero thickness, or the nozzle portion 134 may not have a front face. The nozzle interior cavity 130 is defined by the interior surface 168 of the nozzle body 118, the interior surface 170 of the rim 116, the interior surface 172 of the angled wall 146, and the second surface 174 of a portion of the orifice wall 150 that extends upstream from the intersection between the angled wall 146 and the orifice wall 150. A fluid passageway 176 is defined by the nozzle interior cavity 130, the post 86, and the outlet channel 148 when the nozzle insert 50 is coupled with the actuator 48. In the nozzle portion 134, the outlet channel 148 extends through the orifice wall 150 to provide fluid communication between the interior cavity 130 and the atmosphere.

Still referring to FIG. 11, the nozzle portion 134 includes the nozzle orifice 136, the orifice wall 150, and the angled wall 146. As previously mentioned, the orifice wall 150 defines the outlet channel 148 and a section of the fluid passageway 176. The nozzle orifice 136 is positioned at the downstream end of the fluid passageway 176. In the illustrated embodiment, the orifice wall 150 extends from the interior cavity 130 through the rim 116 and nozzle portion 134 to the nozzle orifice 136. In some embodiments, a diameter or other aspect of the orifice wall 150 may be designed to achieve a desired flow pattern and/or atomization of the fluid flowing therethrough. In some embodiments, the diameter of the orifice wall 150 may be between about 0.75 millimeters (mm) and about 2.50 mm, or between about 0.75 mm and about 2.00 mm, or between about 0.75 mm and about 1.25 mm, or between about 0.75 mm and about 1.0 mm. In some embodiments, the diameter of the orifice wall 150 may be about 1.00 mm. In some embodiments, the diameter of the orifice wall 150 may be between about 1.50 mm and about 2.50 mm, or between about 1.75 mm and about 2.30 mm, or about 2.00 mm, or about 1.30 mm. In the illustrated embodiment, the orifice wall 150 is arranged concentrically to the rim front surface 132. In some embodiments, for example, the orifice wall 150 may be eccentrically arranged (i.e., arranged off-center) relative to the rim front surface 132 to provide a desired flow pattern and/or atomization of the fluid flow therethrough.

In some embodiments, multiple outlet orifice walls may be provided. In the illustrated embodiment, the first nozzle portion 152 extends laterally forward from the rim front surface 132. The angled wall 146 extends radially inward and laterally forward from the first nozzle portion 152. The angled wall 146 intersects with the orifice wall 150. The orifice wall 150 extends laterally forward from the angled wall 146. Additionally, the orifice wall 150 extends laterally rearward from the intersection with the angled wall 146 toward the interior cavity 130. In the illustrated embodiment, the orifice wall 150 extends laterally rearward, past the rearmost point of the angled wall 146 but ends before the rearmost point of the rim 116. In some embodiments, the orifice wall 150 may extend rearward, past the rearmost point of the rim 116. In some embodiments, the orifice wall may extend past the intersection of the angled wall 146 and the orifice wall 150, but not past the forwardmost point of the rim 116. With the orifice wall 150 extending laterally rearward from the angled wall 146, a gap 198 is created. The gap 198 further defines a section of the fluid passageway 176.

Still referring to FIG. 11, in the illustrated embodiment, each of the ribs 180 include a semispherical ramp portion 200 and a spacer portion 202. Further, the ribs 180 extend from the stop surface 190 of the raised portions 182 laterally rearward. The ribs 180 end before the chamfered step 126. In further embodiments, the ribs 180 may be an alternative shape such as, but not limited to, a rectangular prism, a triangular prism, a cone, or an irregular shape. Further, in other embodiments, the ribs 180 may be longer or shorter in length, causing the ribs 180 to extend more or less rearward, respectively. In the illustrated embodiment, the ribs 180 intersect with the flat-faced stop surface 190 of the raised portion 182 at a right angle. In further embodiments, the ribs 180 and the raised portion 182 may intersect at an oblique angle, or may not intersect at all.

Figure 12:
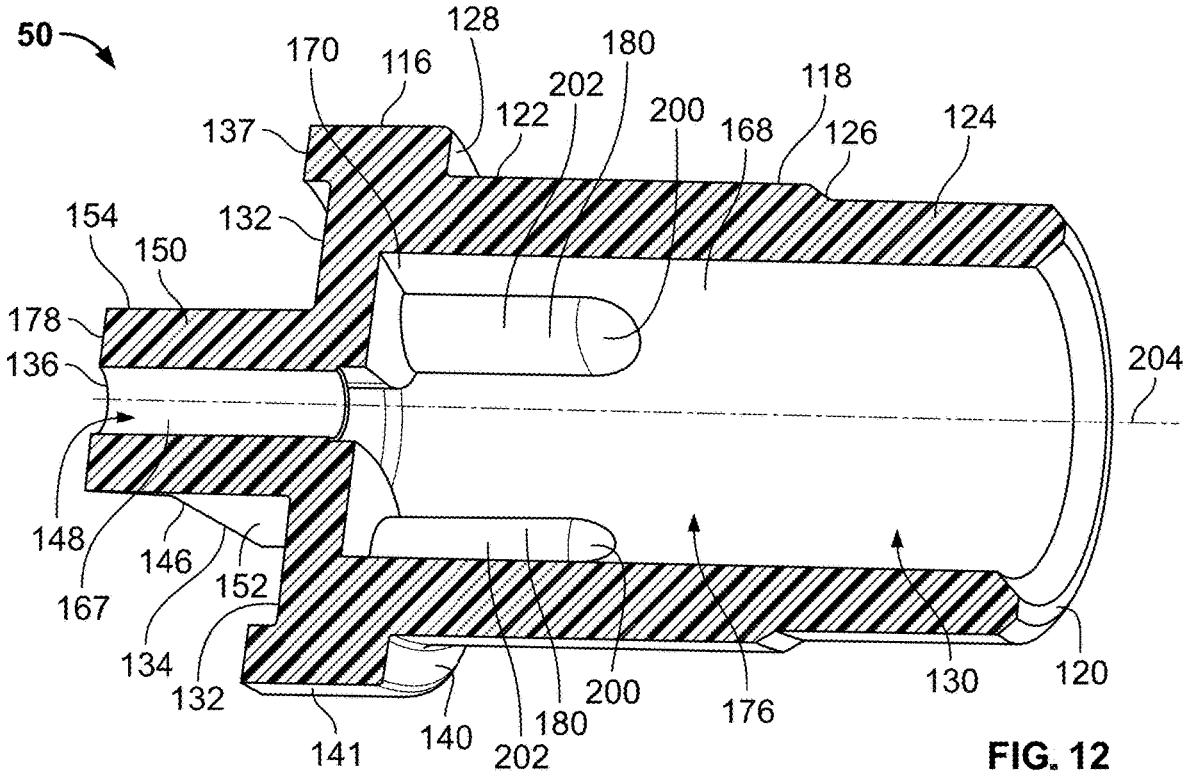
FIG. 12 is a side cross-sectional view of the nozzle insert taken through line 12-12 of FIG. 8.

As shown in FIG. 12, the orifice wall 150 extends to the rim front surface 132. Further, a first axis 204 runs longitudinally through the interior cavity 130 and the outlet channel 148. The ribs 180 extend laterally rearward along the first axis 204 from the rearmost plane defined by the rim 116 along the interior surface 168 of the body. In further embodiments, the ribs 180 may be longer or shorter in length, causing the ribs 180 to extend more or less rearwardly, respectively. As illustrated in FIGS. 11 and 12, in some embodiments, the ribs 180 may all have the same length, but in further embodiments, only some of the ribs 180 may have the same length, or none of the ribs 180 will have the same length, i.e., the ribs 180 may have different lengths.

Figure 13:
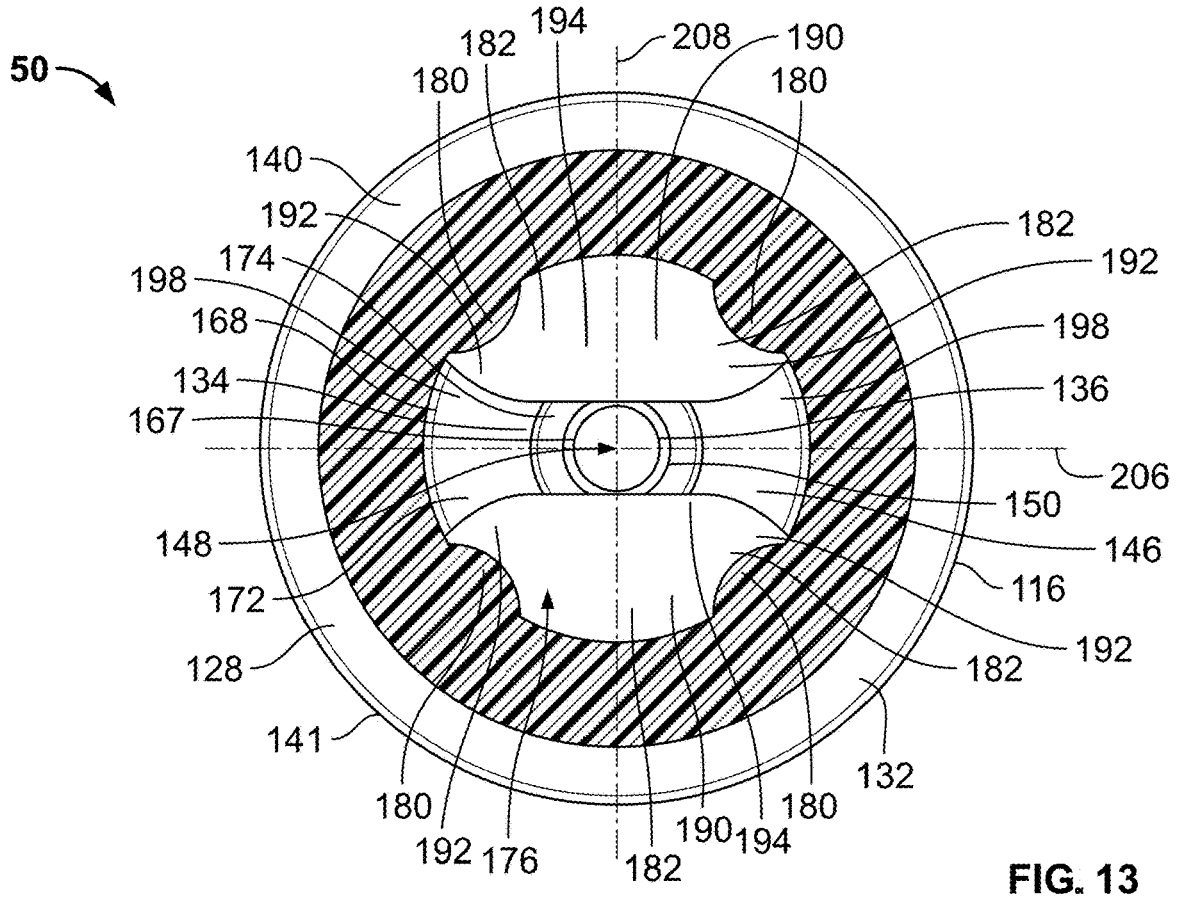
FIG. 13 is a front cross-sectional view of the nozzle insert taken through line 13-13 of FIG. 7.

Referring to FIG. 13, a front cross-sectional view of the nozzle insert 50 is shown at the intersection of the rim 116 and the nozzle body 118 (see FIG. 12). A second axis or plane 206 is defined as running perpendicular to the first axis 204. A third axis or plane 208 is defined as extending perpendicular to the first axis 204 and the second axis 206. On the plane defined by cross-section line 13-13 of FIG. 7, the fluid passageway 176 is generally cylindrical except for the plurality of ribs 180 that extend radially inward toward the first axis 204. On the plane defined by cross-section line 13-13 of FIG. 7, the fluid may flow forward toward the raised portions 182, the gap 198, or the outlet channel 148.

Figure 14:
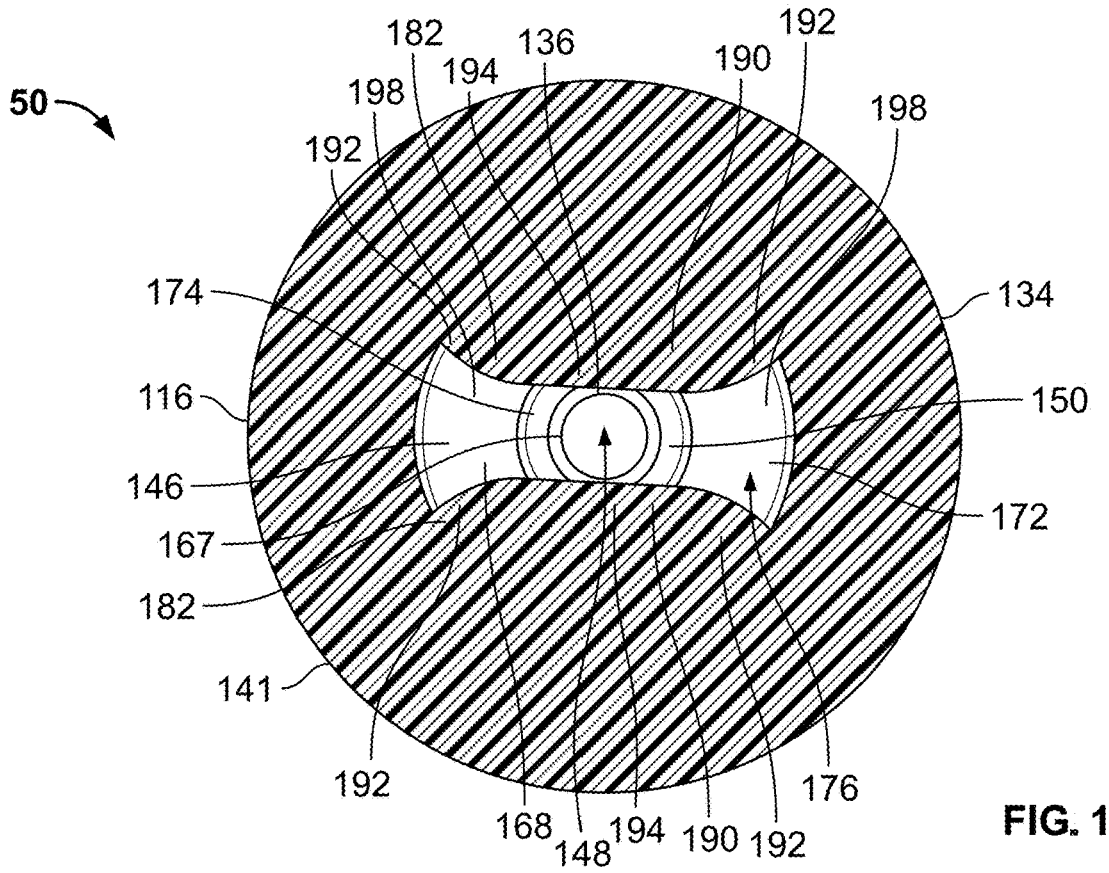
FIG. 14 is a front cross-sectional view of the nozzle insert taken through line 14-14 of FIG. 7.

Turning to FIG. 14, a front cross-sectional view of the nozzle insert 50 is shown at the rearmost point of the orifice wall 150. On the plane defined by cross-section line 14-14 of FIG. 7, the fluid passageway 176 is generally cylindrical. The raised portions 182 narrow the fluid passageway 176 to the gap 198 and the outlet channel 148. In the illustrated embodiment, the raised portions 182 extend radially inward towards the first axis 204 to meet the orifice wall 150. In some embodiments, the raised portions 182 may extend more or less radially inward. The angled wall 146 (see FIG. 11) is not flush with the orifice wall 150, and the gap 198 between the angled wall 146 and the orifice wall 150 is not blocked by the raised portions 182. Along the plane defined by line 14-14 of FIG. 7, the fluid may flow past the raised portions 182. Then, the fluid may enter the outlet channel 148 defined by the orifice wall 150, or the fluid may enter the gap 198.

Figure 15:
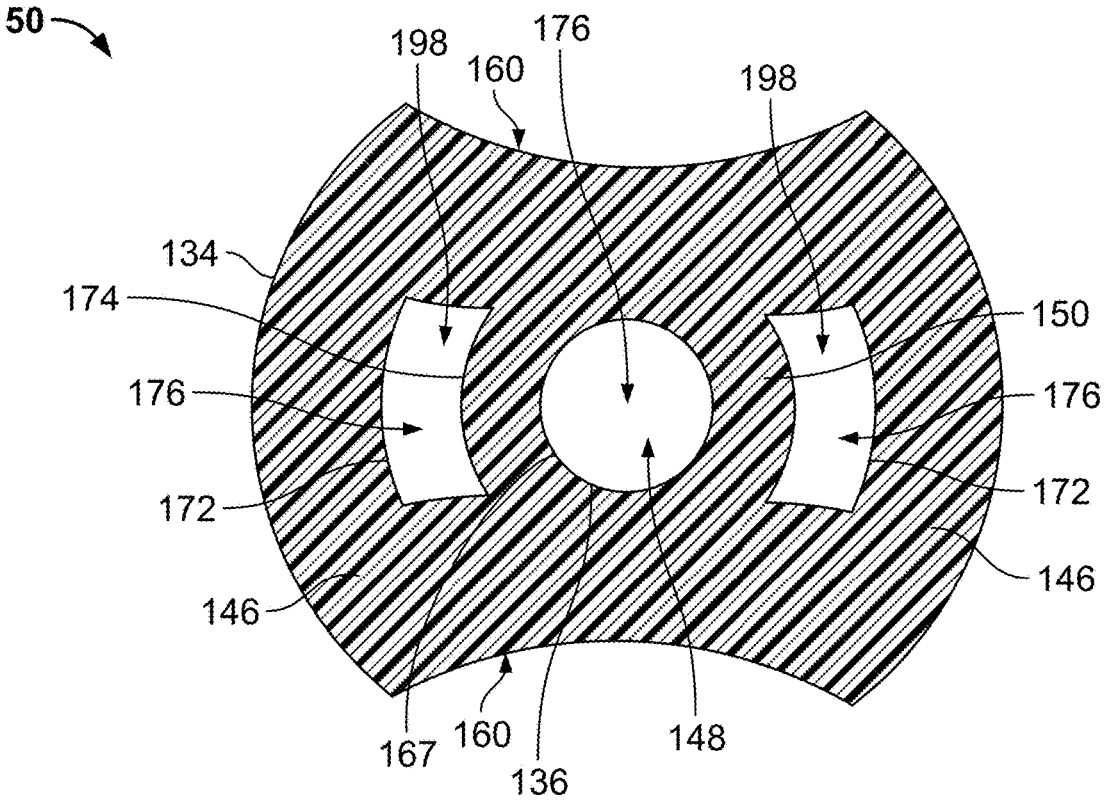
FIG. 15 is a front cross-sectional view of the nozzle insert taken through line 15-15 of FIG. 7.

Now referring to FIG. 15, a front cross-sectional view of the nozzle insert 50 is shown along line 15-15 of FIG. 7, where the angled wall 146 meets the rim front surface 132. The shape of the nozzle portion 134 is generally circular, and the cavities 160 are elliptical in shape. The cavities 160 define two concave sides of the radially central wall 139. The cavities 160 also define two concave sides of the angled wall 146. The cross-section of the gap 198 between the angled wall 146 and the orifice wall 150 is a curved rectangle in the illustrated embodiment. Further, the gap 198 tapers as the angled wall 146 moves radially inward toward the orifice wall 150. In some embodiments, the gap 198 may have an alternative cross-sectional shape, such as, but not limited to, a rectangle, square, triangle, oval, circle, or irregular shape. Along the plane defined by cross-section line 15-15 of FIG. 7, the fluid that entered the outlet channel 148 defined by the orifice wall 150 during the previous step will move to exit the system. The fluid that entered the gap 198 will rebound and be further agitated before entering the outlet channel 148. In this sense, the gap 198 acts as a swirl chamber.

Figure 16:
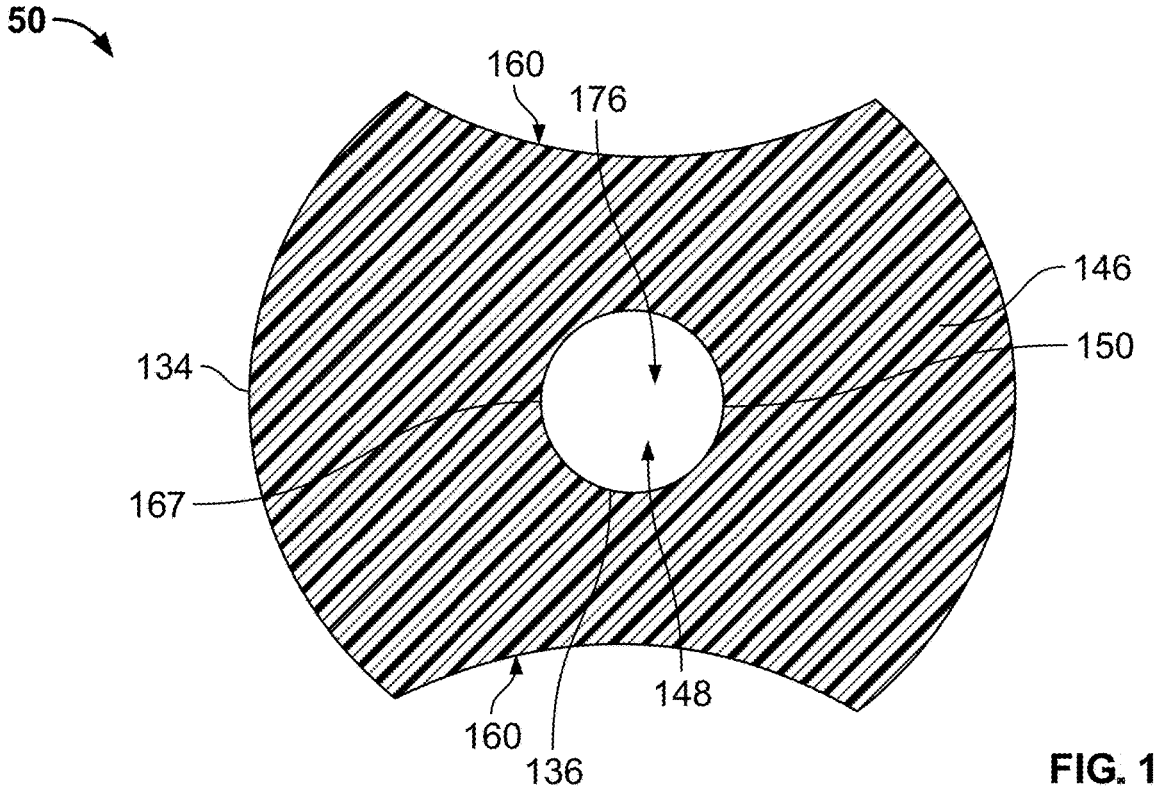
FIG. 16 is a front cross-sectional view of the nozzle insert taken through line 16-16 of FIG. 7.

FIG. 16 illustrates a front cross-sectional view of the nozzle insert 50 taken along line 16-16 of FIG. 7. On the plane defined by cross-section line 16-16 of FIG. 7, the nozzle portion 134 is generally circular in shape, but the cavities 160 extend radially inward to create a non-circular shape. The orifice wall 150 defines the cylindrical fluid passageway 176, which is now the same as the outlet channel 148, and which is solely defined by the orifice wall 150. Along the plane defined by cross-section line 16-16 of FIG. 7, the fluid is located within the outlet channel 148 and moves forward to exit the nozzle insert 50 at the nozzle orifice 136, and there is no gap between the angled wall 146 and the orifice wall 150.

Figure 17:
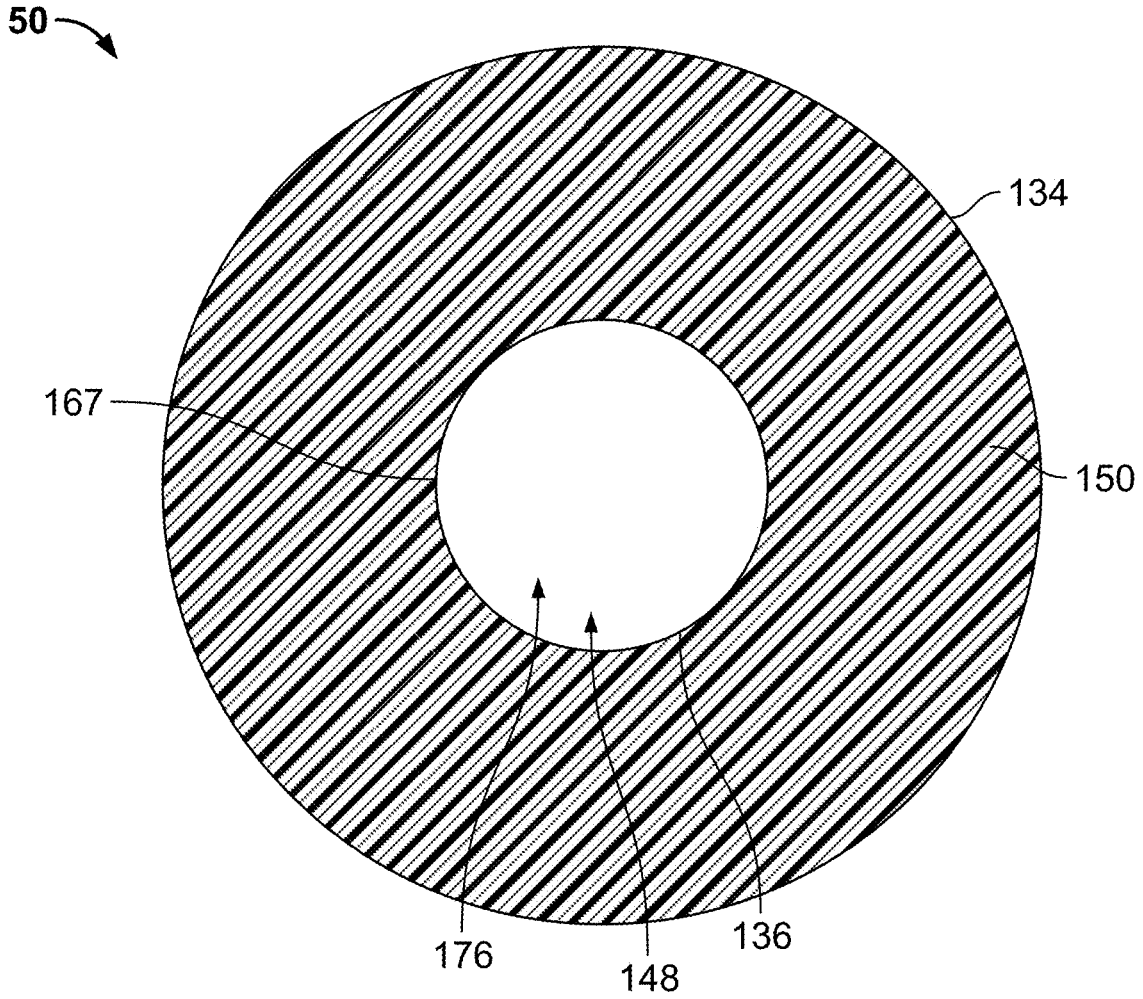
FIG. 17 is a front cross-sectional view of the nozzle insert taken through line 17-17 of FIG. 7.

Finally, referring to FIG. 17, a cross-sectional view is shown of the nozzle insert 50 along line 17-17 of FIG. 7, on a forwardmost plane where the angled wall 146 intersects the orifice wall 150. Along the plane defined by line 17-17 of FIG. 7 the nozzle portion 134 is circular in shape and solely defined by the orifice wall 150. The fluid passageway 176, which is the same as the outlet channel 148, and which is now solely defined by the orifice wall 150, is cylindrical in shape and located concentric to the orifice wall 150. In other embodiments, the fluid passageway 176 and the outlet channel 148 may be a different shape, or may be located eccentrically within the orifice wall 150, or a combination of both. Along the plane defined by line 17-17 of FIG. 7, the fluid is still located within the fluid passageway 176 and the outlet channel 148 and moves forward to exit the nozzle insert 50 at the nozzle orifice 136.

Next, as will be discussed herein, the compositions or formulations of the present disclosure provide a pest control or insecticidal composition with reduced levels of VOC (e.g., less than 8 wt. % VOC). Further, to achieve these low levels of VOCs, the compositions employ a combination of effective non-VOC solvents, optimal propellant formulations and concentrations, and beneficial amounts of emulsifiers. Each of these aspects, along with the other components of the compositions, will now be discussed in detail.

Active agent.

The active agent imparts insecticidal and/or insect repellent properties to the low-VOC pest composition. In some embodiments, the active agent of the pest control compositions of the present disclosure can include one or more pyrethrins, pyrethroids, and combinations thereof. In specific embodiments, the active agent or agents of the low-VOC pest control composition includes one or more of imiprothrin, cypermethrin, deltamethrin, and combinations thereof. In some embodiments, the active of the low-VOC pest control composition includes cypermethrin. In other embodiments, the active of the low-VOC pest control composition includes imiprothrin. In other embodiments, the active of the low-VOC pest control composition includes deltamethrin. In other embodiments, the active of the low-VOC pest control composition includes cypermethrin and imiprothrin. In other embodiments, the active of the low-VOC pest control composition includes imiprothrin and deltamethrin.

The one or more active agents may be included in a range between about 0.01 wt. % and about 5 wt. %, or between about 0.01 wt. % and about 3 wt. %, or between about 0.01 wt. % and about 2 wt. %, or between about 0.01 wt. % and about 1 wt. %, or between about 0.01 wt. % and about 0.5 wt. %, or between about 0.01 wt. % and about 0.3 wt. %, or between about 0.01 wt. % and about 0.25 wt. %, or between about 0.01 wt. % and about 0.2 wt. %. Further, in particular embodiments, the one or more active agents may be included in a concentration of about 0.22 wt. %.

Cypermethrin (CAS No. 52315-07-8) is a synthetic pyrethroid that behaves as a fast-acting neurotoxin in insects. Cypermethrin has the IUPAC name [cyano-(3-phenoxyphenyl)methyl] 3-(2,2-dichloroethenyl)-2,2-dimethylcyclopropane-1-carboxylate. Cypermethrin can be included in the composition in at least 0.005 wt. % or at least 0.01 wt. % and up to about 0.02 wt. %, up to about 0.03 wt. %, up to about 0.04 wt. %, up to about 0.05 wt. %, up to about 0.06 wt. %, up to about 0.07 wt. %, up to about 0.08 wt. %, up to about 0.09 wt. %, up to about 0.1 wt. %, up to about 0.1034 wt. %, up to about 0.11 wt. %, up to about 0.12 wt. %, or up to about 0.15 wt. %. In other embodiments, cypermethrin may be included in a range between about 0.01 wt. % and about 5 wt. %, or between about 0.01 wt. % and about 3 wt. %, or between about 0.01 wt. % and about 2 wt. %, or between about 0.01 wt. % and about 1 wt. %, or between about 0.01 wt. % and about 0.5 wt. %, or between about 0.01 wt. % and about 0.3 wt. %, or between about 0.01 wt. % and about 0.2 wt. %, or between about 0.01 wt. % and about 0.15 wt. %. Further, in particular embodiments, the cypermethrin may be included in a concentration of about 0.1 wt. %.

Imiprothrin (CAS No. 72963-72-5) is a synthetic pyrethroid that behaves as a fast-acting neurotoxin in insects. Imiprothrin has the IUPAC name [2,5-Dioxo-3-(prop-2-yn-1-yl) imidazolidin-1-yl]methyl 2,2-dimethyl-3-(2-methylprop-1-en-1-yl) cyclopropane-1-carboxylate. Imiprothrin can be included in the composition in at least 0.005 wt. % or at least 0.01 wt. % and up to about 0.02 wt. %, up to about 0.03 wt. %, up to about 0.04 wt. %, up to about 0.05 wt. %, up to about 0.06 wt. %, up to about 0.07 wt. %, up to about 0.08 wt. %, up to about 0.09 wt. %, up to about 0.1 wt. %, up to about 0.11 wt. %, up to about 0.1188 wt. %, up to about 0.12 wt. %, or up to about 0.15 wt. %. In other embodiments, imiprothrin may be included in a range between about 0.01 wt. % and about 5 wt. %, or between about 0.01 wt. % and about 3 wt. %, or between about 0.01 wt. % and about 2 wt. %, or between about 0.01 wt. % and about 1 wt. %, or between about 0.01 wt. % and about 0.5 wt. %, or between about 0.01 wt. % and about 0.3 wt. %, or between about 0.01 wt. % and about 0.2 wt. %, or between about 0.01 wt. % and about 0.15 wt. %. Further, in particular embodiments, the imiprothrin may be included in a concentration of about 0.12 wt. %.

Deltamethrin (CAS No. 52918-63-5) is a synthetic pyrethroid that behaves as a fast-acting neurotoxin in insects. Deltamethrin has the IUPAC name [(S)-cyano-(3-phenoxyphenyl)methyl] (1R,3R)-3-(2,2-dibromoethenyl)-2,2-dimethylcyclopropane-1-carboxylate. Deltamethrin can be included in the composition in at least 0.01 wt. % or at least 0.05 wt. % or at least 0.1 wt. % and up to about 0.15 wt. %, up to about 0.2 wt. %, up to about 0.25 wt. %, up to about 0.3 wt. %, up to about 0.35 wt. %, up to about 0.4 wt. %, up to about 0.45 wt. %, or up to about 0.5 wt. %. In other embodiments, deltamethrin may be included in a range between about 0.01 wt. % and about 5 wt. %, or between about 0.01 wt. % and about 3 wt. %, or between about 0.01 wt. % and about 2 wt. %, or between about 0.01 wt. % and about 1 wt. %, or between about 0.01 wt. % and about 0.5 wt. %, or between about 0.01 wt. % and about 0.3 wt. %, or between about 0.01 wt. % and about 0.2 wt. %, or between about 0.01 wt. % and about 0.15 wt. %. Further, in particular embodiments, deltamethrin may be included in a concentration of about 0.3 wt. %.

Solvent.

The composition of the present disclosure may also include a solvent, for example to dissolve certain components, to enhance functionality of the components, or for textural and sensorial attributes. In some embodiments, the solvent includes at least one of citric acid esters, cyclohexanone, glycol ethers, C14-C16 saturated alkanes, C11-C16 aliphatic hydrocarbons, and combinations thereof. In further embodiments, the solvent may additionally or alternatively include ethanol and acetone. The concentration of these non-VOC solvents is important for product performance because they dictate the rate at which the emulsion breaks. If the emulsion breaks too quickly, the composition dispenses as a continuous stream, rather than an aerosolized spray.

In certain embodiments, the composition includes a solvent. In these embodiments, the solvent may include at least one of citric acid esters, cyclohexanone, glycol ethers, C14-C16 saturated alkanes, C11-C16 aliphatic hydrocarbons, and combinations thereof. These C11-C16 aliphatic hydrocarbons may have no lingering chemical odors. In particular embodiments, the composition includes a hydrocarbon solvent and a non-VOC solvent. In these embodiments, the non-VOC solvent may be a citric acid ester, a glycol ether, or a combination thereof. Further, in these embodiments, the non-VOC solvents may assist with solubilizing the active agents, including cypermethrin, which has limited solubility in many solvents. Even further, the non-VOC solvent may solubilize with alkanes, C14-C16 linear hydrocarbon solvents, or other hydrocarbon solvents.

The concentration of the non-VOC solvent may also be critical to the functioning of the composition and may determine many parameters of the composition, such as how fast the emulsion breaks. For example, if the emulsion breaks too fast, the spray from the can may come out as a continuous stream and not an aerosolized spray, which is undesirable. Further, sometimes small variations in solvent amount may cause an emulsion to break too quickly and/or not form in the can when shaken. As such, one skilled in the art would understand the complexities with creating compositions with such solvents and the difficulty in creating optimal aerosol compositions having non-VOC solvents.

In some embodiments, the composition includes about 1 wt. % to about 55 wt. % of the solvent, and in some other embodiments, the composition includes about 1 wt. % to about 35 wt. % of the solvent, based on the total weight of the composition. In further embodiments, the composition includes about 25 wt. % to about 52 wt. % of the solvent based on the total weight of the composition. In further embodiments, the composition includes about 20 wt. % to about 35 wt. % of the solvent based on the total weight of the composition. In other embodiments, the composition includes a solvent present in about 28 wt. % to about 34 wt. %, based on the total weight of the composition, or between about 29 wt. % to about 34 wt. %, based on the total weight of the composition. In another embodiment, the solvent is present between about 28 wt. % to about 29 wt. %, based on the total weight of the composition. In another embodiment, the solvent is present between about 29 wt. % to about 30 wt. %, based on the total weight of the composition. In another embodiment, the solvent is present between about 30 wt. % to about 31 wt. %, based on the total weight of the composition. In yet another embodiment, the solvent is present between about 32 wt. % to about 33 wt. %, based on the total weight of the composition. In yet another embodiment, the solvent is present between about 33 wt. % to about 34 wt. %, based on the total weight of the composition. In other embodiments, the one or more solvents may be individually present in an amount ranging from about 0.01 wt. % and about 10 wt. %, or between about 0.01 wt. % and about 7 wt. %, or between about 0.01 wt. % and about 5 wt. %, or between about 0.01 wt. % and about 4.5 wt. %, or between about 0.01 wt. % and about 3 wt. %, or between about 0.01 wt. % and about 2.5 wt. %. While specific values chosen for this embodiment are recited, it is to be understood that, within the scope of the disclosure, the concentration of solvent may vary to suit different applications. The concentration ranges of solvents will vary based on the additional components of the pest control composition, including, but not limited to, the cypermethrin, deltamethrin, imiprothrin, emulsifier, propellant, corrosion inhibitor, and carrier.

Additionally, according to one embodiment, the solvent includes at least one of citric acid esters, cyclohexanone, glycol ethers, C14-C16 saturated alkanes, C11-C16 aliphatic hydrocarbons, and/or combinations thereof. For example, in an embodiment, the solvent includes at least one of C14-C16 saturated alkanes, glycol ethers, and/or combinations thereof. In another embodiment, the solvent includes at least one of C14-C16 saturated alkanes, citric acid esters, and/or combinations thereof. In an even further embodiment, the solvent is selected from the group consisting of citric acid esters, cyclohexanone, glycol ethers, C14-C16 saturated alkanes, C11-C16 aliphatic hydrocarbons, and/or combinations thereof.

Further, according to one embodiment, the solvent includes C11-C16 aliphatic hydrocarbons. Here, the solvent may be an isoparaffin or isoparaffinic hydrocarbon, including synthesized mixtures of hydrocarbons. For example, some exemplary embodiments may include one or more of the following solvents: Ketrul® D100 (TotalEnergies SE, La Défense 6, France), Isopar® M (Exxon Mobil Corporation, Irving, TX), Isopar™ L (Exxon Mobil Corporation, Irving, TX), SMD 100 by Sinopec, SMD 95 by Sinopic, ShellSol TD, and combinations thereof. In these embodiments, the composition includes about 25 wt. % to about 44 wt. % of C11-C16 aliphatic hydrocarbons, based on the total weight of the composition. In further embodiments, the composition includes about 28 wt. % to about 35 wt. % of C11-C16 aliphatic hydrocarbons, based on the total weight of the composition, or about 28.20 wt. % to about 34.50 wt. %. In even further embodiments, the composition includes about 30.7 wt. % to about 30.8 wt. % of C11-C16 aliphatic hydrocarbons, based on the total weight of the composition. In other embodiments, however, the composition is substantially free of C11-C16 aliphatic hydrocarbons. While specific values chosen for this embodiment are recited, it is to be understood that, within the scope of the disclosure, the concentration of C11-C16 aliphatic hydrocarbons may vary to suit different applications. The concentration ranges of C11-C16 aliphatic hydrocarbons, for example, will vary based on the additional components of the pest control composition, such as the active agents, the propellant, and the carrier.

In another embodiment, the solvent includes C14-C16 saturated alkanes. Here, the solvent may include a solvent of alkane mixtures. For example, some exemplary embodiments may include one or more of the following solvents: Ketrul® D100 (TotalEnergies SE, La Défense 6, France); gas-to-liquid (GTL) solvents, such as GS1927; Linpar® 1416 (Sasol Italy S.P.A., Milano, Italy), Ketrul® D80 (TotalEnergies SE, La Défense 6, France), SMD 80 by Sinopec, and/or Exxsol™ D80 (Exxon Mobil Corporation, Irving, TX). In these embodiments, the composition includes about 25 wt. % to about 44 wt. % of C14-C16 saturated alkanes, based on the total weight of the composition. In further embodiments, the composition includes about 28 wt. % to about 35 wt. % of C14-C16 saturated alkanes, based on the total weight of the composition. In even further embodiments, the composition includes about 28.2 wt. % to about 34.5 wt. % of C14-C16 saturated alkanes, based on the total weight of the composition. In still further embodiments, the composition includes about 32.64 wt. % of C14-C16 saturated alkanes, based on the total weight of the composition. In other embodiments, however, the composition is substantially free of C14-C16 saturated alkanes. While specific values chosen for this embodiment are recited, it is to be understood that, within the scope of the disclosure, the concentration of C14-C16 saturated alkanes may vary to suit different applications. The concentration ranges of C14-C16 saturated alkanes, for example, will vary based on the additional components of the pest control composition, such as the active agents, the propellant, and the carrier.

In yet another embodiment, the solvent includes glycol ethers. For example, some exemplary embodiments may include one or more of the following solvents: Butyl CARBITOL™ Solvent (Dow Chemical Co., Midland, MI), DOWANOL® DPnP Glycol Ether (Dow Chemical Co., Midland, MI), Hexyl CARBITOL™ Solvent (Dow Chemical Co., Midland, MI), Hexyl CELLOSOLVE™ (Dow Chemical Co., Midland, MI), DOWANOL® PPh Glycol Ether (Dow Chemical Co., Midland, MI), and/or glycol ether solvents offered by LyondellBasell® (LyondellBasell Industries Holdings BV (besloten vennootschap (b.v.); NETHERLANDS)), including glycol ether DB and glycol ether DE, for example. In these embodiments, the composition includes about 0.1 wt. % to about 10 wt. % of glycol ethers, based on the total weight of the composition. In further embodiments, the composition includes about 0.15 wt. % to about 5 wt. % of glycol ethers, based on the total weight of the composition. In even further embodiments, the composition includes about 0.2 wt. % to about 2.5 wt. % of glycol ethers, based on the total weight of the composition. In other embodiments, the composition includes about 0.2 wt. % to about 1.5 wt. %, or about 0.2 wt. % to about 1.3 wt. % of glycol ethers, based on the total weight of the composition. In some embodiments, however, the composition is substantially free of glycol ethers. While specific values chosen for this embodiment are recited, it is to be understood that, within the scope of the disclosure, the concentration of glycol ethers may vary to suit different applications. The concentration ranges of glycol ethers, for example, will vary based on the additional components of the pest control composition, such as the active agents, the propellant, and the carrier.

Still further, in some embodiments, the solvent includes citric acid esters. For example, some exemplary embodiments may include one or more of the following solvents: a triethyl citrate (e.g., Citroflex® C-2 Aurorium Holdings LLC, Indianapolis, IN), acetyltriethyl citrate (e.g., Citroflex® A-2), tri-n-butyl citrate (e.g., Citroflex® C-4), acetyl-tri-n-butyl citrate (Citroflex® A-4), acetyltri-n-hexyl citrate (Citroflex® A-6), n-Butyryltri-n-hexyl citrate (Citroflex® B-6), and combinations thereof. Citroflex® solvents are biodegradable and non-toxic, and Citroflex® A-4, also called acetyl-tri-n-butyl citrate, is phthalate-free. In these embodiments, the composition includes about 0.1 wt. % to about 10 wt. % of citric acid esters, based on the total weight of the composition. In further embodiments, the composition includes about 0.15 wt. % to about 8 wt. % of citric acid esters, based on the total weight of the composition. In even further embodiments, the composition includes about 0.2 wt. % to about 2.5 wt. % of citric acid esters, based on the total weight of the composition. In other embodiments, the composition includes about 0.2 wt. % to about 1.3 wt. % of citric acid esters, based on the total weight of the composition. In other embodiments, however, the composition is substantially free of citric acid esters. While specific values chosen for this embodiment are recited, it is to be understood that, within the scope of the disclosure, the concentration of citric acid esters may vary to suit different applications. The concentration ranges of glycol ethers, for example, will vary based on the additional components of the pest control composition, such as the active agents, the propellant, and the carrier.

Emulsifier.

The composition of the present disclosure may also include an emulsifier, for example, to keep the active ingredient emulsified in the composition. The concentration of emulsifier is also important for product performance. A composition having too low a concentration of emulsifier exhibits inferior spray due to incomplete emulsion formation, while a composition having too high a concentration of emulsifier exhibits a thick, foamy spray which impacts insecticide performance. In some embodiments, the composition includes an emulsifier. In some embodiments, the emulsifier includes at least one of lecithin, sodium lauryl sulfate, sodium oleate, potassium oleate, sodium ricinolate, Quillaja saponin, polyglyceryl oleate, glyceryl monooleate, sorbitan monooleate, and any combinations thereof.

In certain embodiments, the emulsifier is present in about 0.01 wt. % to about 5 wt. %, based on the total weight of the composition. In an embodiment, the emulsifier is present from about 0.01 wt. % to about 4 wt. %, based on the total weight of the composition. In other embodiments, the composition includes about 0.01 wt. % to about 3 wt. % emulsifier, based on the total weight of the composition. In some embodiments, the composition includes about 0.01 wt. % to about 2 wt. % emulsifier, based on the total weight of the composition. In certain embodiments, the composition includes about 0.01 wt. % to about 1 wt. % emulsifier, based on the total weight of the composition. In an embodiment, the emulsifier is present from about 0.01 wt. % to about 0.5 wt. %, based on the total weight of the composition. In an embodiment, the emulsifier is present from about 0.05 wt. % to about 0.2 wt. %, based on the total weight of the composition. In even further embodiments, however, the composition is substantially free of an emulsifier. While specific values chosen for this embodiment are recited, it is to be understood that, within the scope of the disclosure, the concentration of emulsifier may vary to suit different applications and product formulations (e.g., foaming aerosol vs. fast breaking emulsion aerosol). The concentration ranges of emulsifier will vary based on the additional components of the pest control composition, including, but not limited to, the solvent, the carrier, corrosion inhibitor, propellant, and the active agents.

Further, according to one embodiment, the emulsifier includes sorbitan monooleate. In this embodiment, the sorbitan monooleate is present from about 0.01 wt. % to about 4 wt. %, based on the total weight of the composition. In other embodiments, the composition includes about 0.01 wt. % to about 3 wt. % sorbitan monooleate, based on the total weight of the composition. In some embodiments, the composition includes about 0.01 wt. % to about 2 wt. % sorbitan monooleate, based on the total weight of the composition. In certain embodiments, the composition includes about 0.01 wt. % to about 1 wt. % sorbitan monooleate, based on the total weight of the composition. In an embodiment, the sorbitan monooleate is present from about 0.05 wt. % to about 0.2 wt. %, based on the total weight of the composition. In further embodiments, the sorbitan monooleate is present at about 0.115 wt. %, based on the total weight of the composition. In even further embodiments, however, the composition is substantially free of sorbitan monooleate. While specific values chosen for this embodiment are recited, it is to be understood that, within the scope of the disclosure, the concentration of sorbitan monooleate may vary to suit different applications. The concentration ranges of sorbitan monooleate will vary based on the additional components of the pest control composition, including, but not limited to, the solvent, the carrier, corrosion inhibitor, propellant, and the active agents.

Carrier.

The composition of the present disclosure may also include a carrier, for example, to help aid in the delivery of the active agents, diluent, and flow aid. The carrier may improve content uniformity and facilitates reproducibility of the applied dose. The carrier, among other ingredients, allows the pesticide to be dispersed effectively. The term "carrier" as used herein means a material, which can be inorganic or organic and of synthetic or natural origin, with which the active agent is mixed or formulated to facilitate its application to the host, area, or other object to be treated, or to facilitate its storage, transport, and/or handling. In general, any of the materials customarily employed in formulating repellents, pesticides, herbicides, or fungicides, are suitable.

In certain embodiments, the composition includes about 5 wt. % to about 95 wt. % of a carrier, or about 5 wt. % and about 90 wt. %, or about 5 wt. % to about 85 wt. %, or about 5 wt. % to about 80 wt. %, or between about 5 wt. % to about 75 wt. %, or between 5 wt. % to about 70 wt. %, or about 5 wt. % to about 65 wt. %. In further embodiments, the formulation includes about 50 wt. % to about 70 wt. % carrier, based on the total weight of the composition. In certain embodiments, the composition includes about 55.5 wt. % to about 62.5 wt. % carrier, based on the total weight of the composition. In other embodiments, the composition includes about 55 wt. % to about 63 wt. % carrier, based on the total weight of the composition. In still further embodiments, the composition includes about 57 wt. % to about 60 wt. % carrier, based on the total weight of the composition. In still further embodiments, the composition includes about 58 wt. % carrier or about 59 wt. % carrier, based on the total weight of the composition. In some embodiments, the carrier includes purified water. In other embodiments, the carrier is purified water. In further embodiments, the carrier is an oil, such as mineral oil. While specific values chosen for this embodiment are recited, it is to be understood that, within the scope of the disclosure, the amount of carrier may vary to suit different applications. The amount ranges of carrier will vary based on the additional components of the pest control composition, such as the active agents, solvent, corrosion inhibitor, and emulsifier.

Corrosion Inhibitor.

The composition of the present disclosure may also include a corrosion inhibitor, for example, to help prevent degradation of a metal container that is used to store and/or dispense the composition. The pest control formulation as disclosed herein can be provided to the user in a metal container. Preventing the corrosion of the container is important to avoid spilling and wasting the contents if the container is stored for an extended period of time between uses. Therefore, a corrosion inhibitor can be added to the formulation to increase shelf life. Corrosion inhibitors can include inorganic compounds as well as aliphatic or aromatic amines, and nitrogen heterocyclic compounds. In specific embodiments herein, the organic salt ammonium benzoate is used as a corrosion inhibitor. In some embodiments, ammonium benzoate is included at about 0.05 wt. % to about 2 wt. %, or about 0.05 wt. % to about 1 wt. %, or about 0.05 wt. % to about 0.5 wt. %, or about 0.05 wt. % to about 0.2 wt. %, based on the total weight of the composition. In some embodiments, ammonium benzoate is included at about 0.075 wt. % to about 0.15 wt. %, based on the total weight of the composition. In a particular embodiment, ammonium benzoate can be included at about 0.08 wt. % to about 0.11 wt. %, based on the total weight of the composition. In a particular embodiment, ammonium benzoate can be included at about 0.090 wt. % or 0.105 wt. %, based on the total weight of the composition. In even further embodiments, however, the composition is substantially free of a corrosion inhibitor. While specific values chosen for this embodiment are recited, it is to be understood that, within the scope of the disclosure, the concentration of corrosion inhibitor may vary to suit different applications. The concentration ranges of corrosion inhibitor will vary based on the additional components of the pest control composition, including, but not limited to, the solvent, the carrier, emulsifier, propellant, and the active agents.

Propellant.

In certain embodiments, the composition includes a propellant, for example, to provide a force to expel the formulation from the container. In certain embodiments, the propellant is selected from the group comprising methane, ethane, propane, pentane, isobutene, n-butane, isobutane, dimethyl ether, carbon dioxide, nitrogen, air, liquified petroleum gas, and any combinations thereof. In certain embodiments, the propellant is selected from the group consisting of methane, ethane, propane, pentane, isobutene, n-butane, isobutane, dimethyl ether, carbon dioxide, nitrogen, air, and any combinations thereof. In some embodiments, the propellant can be pressurized in the can to about 50 psi, about 60 psi, about 70 psi, about 80 psi, about 90 psi, or about 100 psi. In other embodiments, the propellant pressure is between about 70 psi and about 100 psi, or between about 80 psi and about 96 psi. In certain embodiments, the composition includes about 1 wt. % to about 10 wt. % of the propellant, based on the total weight of the composition. In certain embodiments, the composition includes about 5 wt. % to about 8 wt. % of the propellant, based on the total weight of the composition. In certain embodiments, the composition includes about 6.5 wt. % to about 8 wt. % of the propellant, based on the total weight of the composition. In certain embodiments, the composition includes about 7 wt. % to about 8 wt. % of the propellant, based on the total weight of the composition. In certain embodiments, the composition includes about 7.5 wt. % of the propellant, based on the total weight of the composition. In specific embodiments, the composition includes a propellant at a weight percentage below 10 wt. %, below 9 wt. %, or below 8 wt. %.

Further, in some embodiments, the propellant is at least partially a part of the composition and dissolves in the active or organic phase of the formulation. As a result, the propellant helps with the formation of the emulsion system. While specific values chosen for this embodiment are recited, it is to be understood that, within the scope of the disclosure, the concentration of propellant may vary to suit different applications. The concentration ranges of propellant will vary based on the additional components of the pest control composition, including, but not limited to, the solvent, the carrier, surfactant, corrosion inhibitor, and the active agents.

In certain embodiments, the propellant includes at least one of isobutane, propane, or combinations thereof. In certain embodiments, the propellant includes a combination of isobutane and propane with an isobutane to propane weight ratio of about 20:80 to about 45:55. In a further embodiment, the propellant includes a combination of isobutane and propane with an isobutane to propane weight ratio of about 30:70. In a further embodiment, the propellant is an A-90 propellant, including a combination of isobutane and propane with an isobutane to propane weight ratio of about 30.16:69.84. In a further embodiment, the propellant is an A-70 propellant, including a combination of isobutane and propane with an isobutane to propane weight ratio of about 57.11:42.89. If the weight ratio of isobutane to propane exceeds 21.27:78.73, it was found that the propellant pressure produces a fine mist, with particle sizes which are ill-suited to targeting crawling insects. When particle sizes are too small, they form fine droplets which allow the active agents or carrier agents to quickly evaporate, which then hinders the delivery of actives through the insect's cuticles. By balancing the isobutane to propane ratio, a stable emulsion which produces the proper energy when leaving the actuator was produced. In particular, a correct balance of the isobutane to propane ratio helped to solubilize with the composition and create an emulsion, while still having enough propane to give the energy needed for flash vaporization in the nozzle. This contrasts with other mainstream aerosols that have much higher propellant pressure, producing fine particles and a wide spray diameter. Once in the air, the propellent in the formula helps break up the formulation into the correct diameter of particles, allowing the composition to hit and coat the target insect. This demonstrates the importance of having the correct propellant ratio in the formula. By optimizing the propellant composition, a formulation which allows for flexibility and interchangeability between actuators and valves was produced.

Fragrance.

In certain embodiments, the composition includes a fragrance, for example, to improve the scent of the composition. A fragrance suitable for use as an active agent may be any suitable natural or synthetic fragrance, based on a single component or blend of components. Fragrances are available commercially from fragrance manufacturers such as Takasago, International Flavors & Fragrances Inc., Quest, Firmenich, Givaudan, Symrise and the like.

In certain embodiments, the fragrance is present in about 0.01 wt. % to about 1 wt. %, based on the total weight of the composition. In an embodiment, the fragrance is present from about 0.01 wt. % to about 0.5 wt. %, based on the total weight of the composition. In other embodiments, the composition includes about 0.1 wt. % to about 0.3 wt. % fragrance, based on the total weight of the composition. In some embodiments, the composition includes about 0.2 wt. % to about 0.25 wt. % fragrance, based on the total weight of the composition. In even further embodiments, however, the composition is substantially free of a fragrance.

Further, the propellant and the concentration thereof may assist with creating optimal spray characteristics for the composition. In particular, in some embodiments, the composition may have a discharge rate between about 1 g/s and about 6.0 g/s, or between about 1.5 g/s and about 4.0 g/s, or between about 2.0 g/s and about 3.5 g/s, or between about 2.2 g/s and about 3.4 g/s, or between about 2.5 g/s and about 3.5 g/s, or between about 2.6 g/s and about 3.2 g/s. In particular embodiments, the composition may have a discharge rate of about 2.9 g/s.

The composition may also have an optimal particle size, such as an optimal Dv(50) value. In some embodiments, the composition may have a Dv(50) value between about 100 μm and about 300 μm, or between about 100 μm and about 250 μm, or between about 130 μm and about 210 μm, or between about 150 μm and about 200 μm, or between about 165 μm and about 195 μm. In particular embodiments, the composition includes a Dv(50) particle size of about 180 μm.

The composition may also have an optimal pattern diameter. In these embodiments, the pattern diameter may be between about 1 inch and about 8 inches, or between about 3 inches and about 5 inches, or between about 3.5 inches and about 4 inches.

The composition may also have an optimal spray distance. In these embodiments, the spray distance may be between about 6 inches and about 30 inches, or between about 15 inches and about 20 inches. In particular embodiments, the spray distance may be about 18 inches.

As shown in FIGS. 18-22, the composition may be used with the product dispensing system 40, including the actuator 48 and the nozzle insert 50. FIGS. 18-22 each illustrate a scale indicating the volume fraction of liquid formula of the composition. The scale is used to indicate the state of the composition at different points along the fluid passageway 176. For descriptive purposes, the below disclosure recites the following states: entirely liquid, substantially liquid, intermediate, substantially gaseous, and entirely gaseous. An entirely liquid state refers to a volume fraction of liquid formula from about 0.8 to about 1.0, a substantially liquid state refers to a volume fraction of liquid formula from about 0.6 to about 0.8, an intermediate state refers to a volume fraction of liquid formula from about 0.4 to about 0.6, a substantially gaseous state refers to a volume fraction of liquid formula from about 0.2 to about 0.4, and an entirely gaseous state refers to a volume fraction of about 0.0 to about 0.2. A start time T0 occurs when the dispensing system 40 is first actuated by a user.

Figure 18:
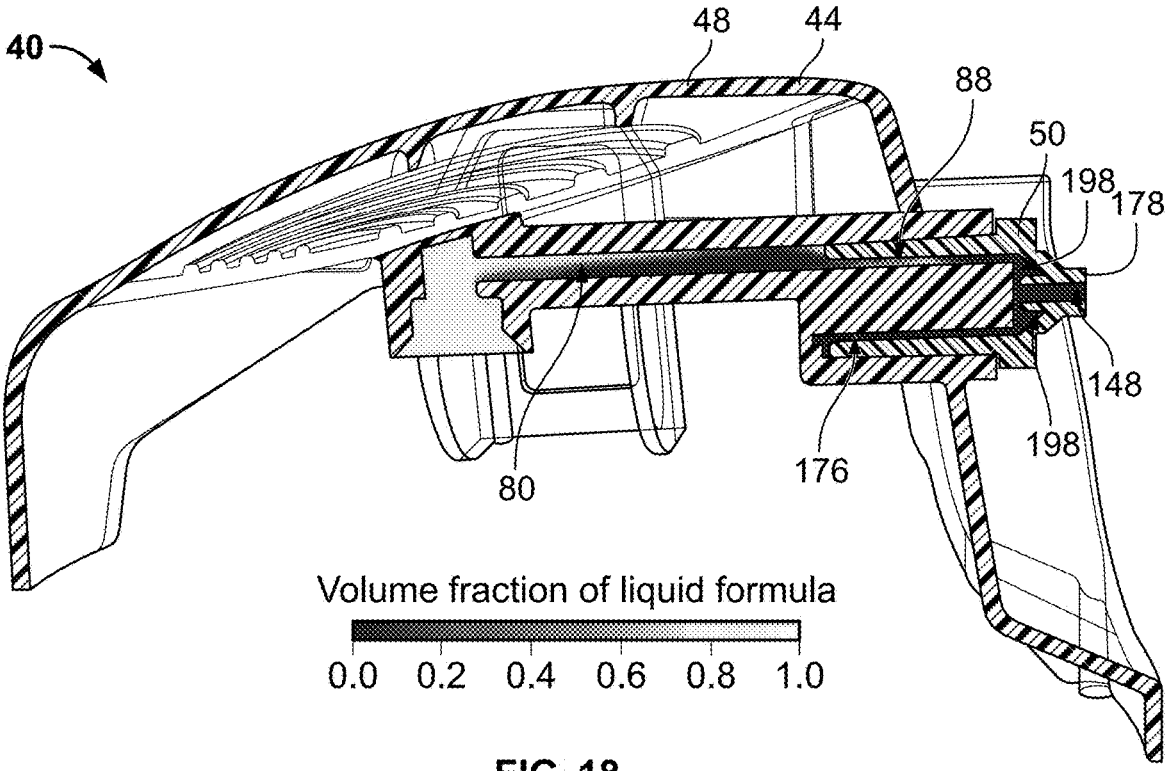
FIG. 18 is a side cross-sectional view of an actuator assembly including the nozzle insert of claim 5 and illustrating a first dispensing state.

Referring to FIG. 18, a first stage occurs at a first time T1. The first time T1 occurs after the start time T0. At the first stage, the composition is in an entirely liquid state when it first enters the actuator assembly 44. As the composition travels through the nozzle conduit 80, the composition transitions to an entirely gaseous state. Once the composition reaches the nozzle insert cavity 88, the composition is in an entirely gaseous state. The gaseous composition fills the fluid passageway 176, including the nozzle insert cavity 88, the gap 198 of the nozzle insert 50, and the outlet channel 148. At the first stage, the dispensing system 40 is not dispensing any composition, so no composition moves past the front face 178 of the nozzle insert 50.

Figure 19:
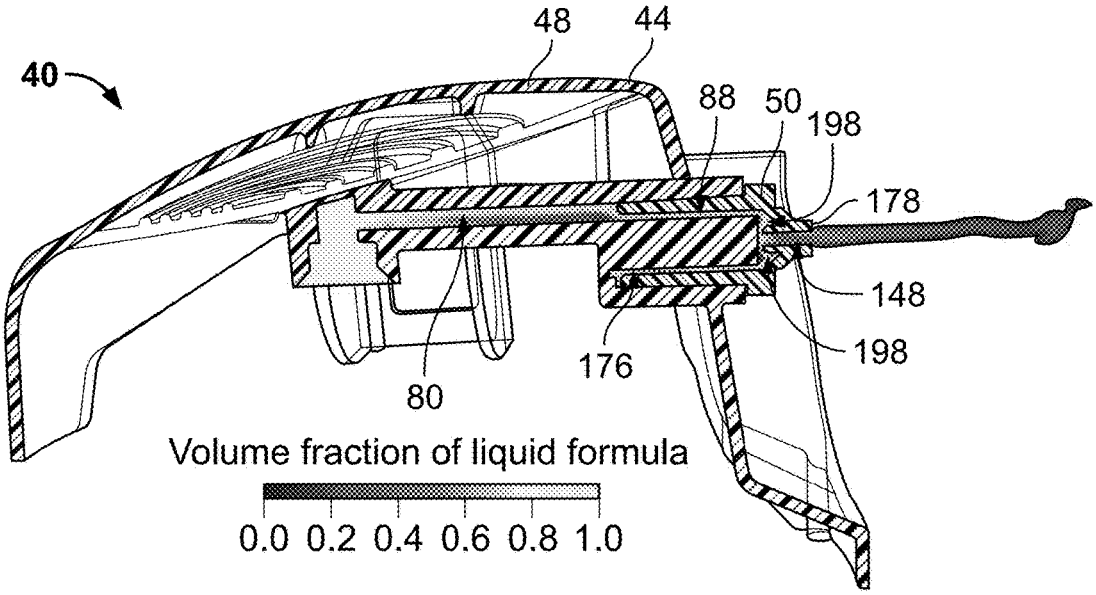
FIG. 19 is a side cross-sectional view of the actuator assembly of FIG. 18 illustrating a second dispensing state.

Turning to FIG. 19, a second stage occurring at a second time T2 is illustrated. The second time T2 occurs after the first time T1. At the second stage, the composition is in an entirely liquid state when the composition first enters the actuator assembly 44. Further, most, but not all, of the nozzle conduit 80 is filled with the composition in an entirely liquid state or substantially liquid state. The remainder of the nozzle conduit 80 is filled with the composition in an intermediate state or in a substantially gaseous state. Once the composition enters the nozzle insert cavity 88, the composition returns to a substantially liquid state and fills the fluid passageway 176. Further, the composition, in a substantially liquid form, fills the gap 198 of the nozzle insert 50. The composition also enters the outlet channel 148, where it quickly transitions to a substantially gaseous state. Once the composition exits the nozzle insert 50 by passing the front face 178 of the nozzle insert 50, the composition is in an entirely gaseous state. The second stage illustrates the composition first exiting the dispensing system 40, and the stream of gaseous composition is a relatively straight path.

Figure 20:
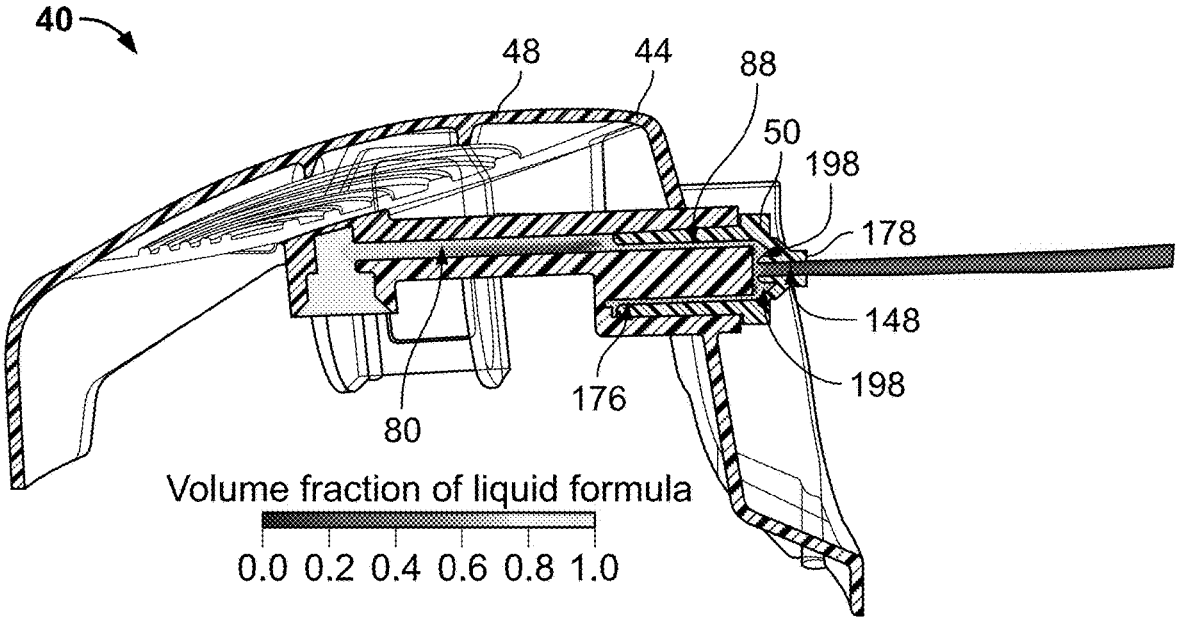
FIG. 20 is a side cross-sectional view of the actuator assembly of FIG. 18 illustrating a third dispensing state.

Now referring to FIG. 20, a third stage occurring at a third time T3 is illustrated. The third time T3 occurs after the second time T2. At the third stage, the composition is still in an entirely liquid state when the composition first enters the actuator assembly 44. Further, most, but not all, of the nozzle conduit 80 is filled with the composition in an entirely liquid state or a substantially liquid state. The remainder of the nozzle conduit 80 is filled with the composition in an intermediate state. Once the composition enters the nozzle insert cavity 88, the composition returns to a substantially liquid state and fills the fluid passageway 176. Further, the composition, in a substantially liquid state, fills the gap 198 of the nozzle insert 50. The composition also enters the outlet channel 148, where it quickly transitions to a substantially gaseous state and then an entirely gaseous state. Once the composition exits the nozzle insert 50 by passing the front face 178 of the nozzle insert 50, the composition is in an entirely gaseous state. The third stage illustrates a steady stream of gaseous composition exiting the dispensing system 40 in a substantially straight path.

Figure 21:
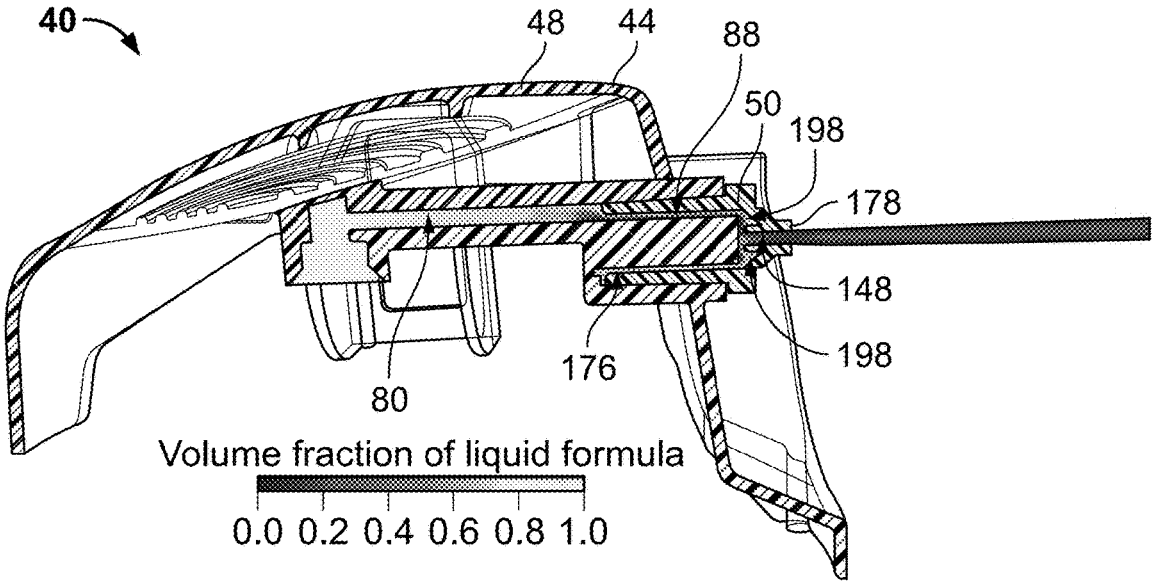
FIG. 21 is a side cross-sectional view of the actuator assembly of FIG. 18 illustrating a fourth dispensing state.

Turning to FIG. 21, a fourth stage occurring at a fourth time T4 is illustrated. The fourth time T4 occurs after the third time T3. At the fourth stage, the composition is still in an entirely liquid state when the composition first enters the actuator assembly 44. Further, most, but not all, of the nozzle conduit 80 is filled with the composition in an entirely liquid state or a substantially liquid state. Once the composition enters the nozzle insert cavity 88, the composition transitions to an intermediate state. The composition in the gap 198 is in a substantially liquid state or an entirely liquid state. The composition in the outlet channel 148 is in an entirely gaseous state. At the fourth stage, a steady stream of composition in an entirely gaseous state exits the dispensing system 40 via the outlet channel 148 in a substantially straight path.

Figure 22:
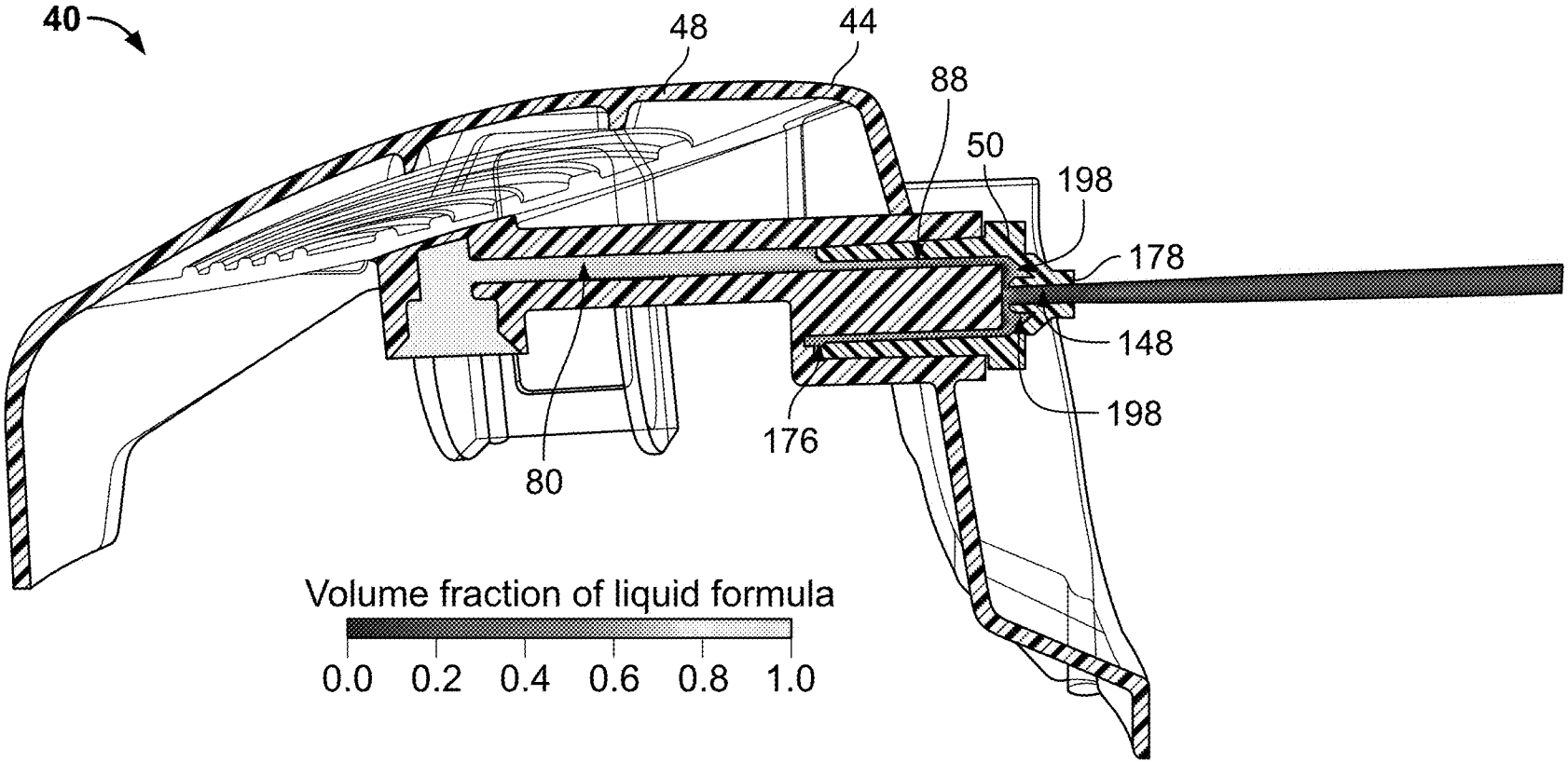
FIG. 22 is a side cross-sectional view of the actuator assembly of FIG. 18 illustrating a fifth dispensing state.

Finally, as shown in FIG. 22, a fifth stage occurring at a fifth time T5 is illustrated. The fifth time T5 occurs after the fourth time T4. At the fifth stage, the composition is in an entirely liquid state when the composition first enters the actuator assembly 44. Further, all of the nozzle conduit 80 is filled with the composition in a liquid state or substantially liquid state. Once the composition enters the nozzle insert cavity 88, the composition transitions to an intermediate or substantially gaseous state. However, the composition in the gap 198 of the nozzle insert 50 is substantially liquid. The composition that enters the outlet channel 148 is in a substantially gaseous state, and quickly transitions to an entirely gaseous state within the outlet channel 148. The fifth stage illustrates a steady stream of composition in an entirely gaseous state exiting the dispensing system 40 via the outlet channel 148 in a substantially straight path.

FIGS. 18-22 illustrate a sequential series of stages that occur between when the dispensing system 40 is first actuated, at the start time T0, and when the dispensing system 40 has reached a steady dispensing state, at the time T5 (see FIG. 22). As illustrated in FIGS. 18-22, the combination of the composition and the nozzle insert 50 creates an optimal spray pattern by leaving the composition in an entirely or substantially liquid state until the composition enters the nozzle insert cavity 88. Further, the optimal spray pattern of the composition and the nozzle insert 50 will be the same whether the dispensing system 40 is filled with the composition or only partially filled with the composition, because the composition does not transition to a gaseous state until the composition enters the nozzle insert cavity 88.

Thus, embodiments of the present disclosure provide a nozzle insert for a product dispensing system. In some embodiments, the improved nozzle insert can provide improved manufacturability and reduce defects arising during assembly (or use) from over-compression of a nozzle insert. For example, some embodiments of the invention provide a nozzle insert, and a corresponding nozzle-insert cavity in an actuator of an actuator assembly that can mitigate the effects of over-compression of the nozzle insert. This can, for example, correspondingly reduce (e.g., eliminate) the probability of forming defects in the actuator assembly during assembly. In some cases, nozzle assemblies for containers (e.g., as included on a larger actuator assembly) can provide a desired flow characteristic (e.g., spray pattern, flow rate, metering effect, and so on).

In alternative embodiments, the composition may include an insecticide disposed within a carrier liquid, a deodorizing liquid, or the like. The composition may also comprise other actives, such as sanitizers, mold or mildew inhibitors, insect repellents, and/or the like. In alternative embodiments, it is contemplated that the container 42 may contain any type of pressurized product and/or mixtures thereof; thus, the product dispensing system 40 may be adapted to dispense any number of different products. In some embodiments, the container 42 may contain liquefied, non-liquefied, or dissolved compressed gas, which may include one or more of the compressed gases listed above. In some embodiments, the container 42 may contain one or more of a hydrocarbon gas or hydrocarbon derivative, including acetylene, methane, propane, butane, isobutene, halogenated hydrocarbons, ethers, mixtures of butane and propane, otherwise known as liquid petroleum gas or LPG, and/or mixtures thereof.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto.

While the methods and systems disclosed herein may be embodied in many different forms, several specific embodiments are discussed herein with the understanding that the embodiments described in the present disclosure are to be considered only exemplifications of the principles described herein, and the disclosure is not intended to be limited to the embodiments illustrated.

Any of the embodiments described herein may be modified to include any of the structures or methodologies disclosed in connection with different embodiments. Further, the present disclosure is not limited to aerosol containers of the type specifically shown. Still further, the overcaps of any of the embodiments disclosed herein may be modified to work with any type of aerosol or non-aerosol container.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use embodiments of the disclosure. The exclusive rights to all modifications which come within the scope of the appended claims are reserved.

We claim:

1. A nozzle insert, comprising:

a body having a front portion and a rear portion;

a rim; and a nozzle portion that includes an angled wall and an orifice wall, the angled wall extending radially inward and laterally forward from the rim, and the orifice wall intersecting with the angled wall and defining a nozzle orifice, wherein the orifice wall extends both laterally forward and rearward from the intersection with the angled wall, wherein a cylindrical inner surface of the orifice wall defines an outlet channel that terminates at a forward end at the nozzle orifice and at a rearward end spaced rearward of a forwardmost end of the angled wall, and wherein an interior cavity of the nozzle insert is defined by an interior surface of the body, an interior surface of the rim, and an interior surface of the angled wall.

2. The nozzle insert of claim 1, wherein the nozzle insert is configured to fit over a post of an external actuator.

3. The nozzle insert of claim 1, wherein the interior cavity and the outlet channel define a fluid passageway and a central axis, wherein the fluid passageway defines a fluid flow path, and wherein the fluid flow path is generally parallel to the central axis.

4. The nozzle insert of claim 1 further comprising a plurality of ribs, wherein the ribs are disposed along the interior surface of the body, and wherein the ribs extend axially toward the interior cavity.

5. The nozzle insert of claim 1 further comprising a nozzle insert cavity defined, in part, by the body of the nozzle insert, wherein the nozzle insert is configured to attach to a container including a composition, wherein at a first time the nozzle insert cavity includes the composition in a gaseous or substantially gaseous state, wherein at a second time the nozzle insert cavity includes the composition in a liquid or substantially liquid state, and wherein the first time occurs before the second time.

6. The nozzle insert of claim 1 further comprising a plurality of raised portions, wherein the raised portions extend radially inward from the interior surface of the rim.

7. The nozzle insert of claim 6, wherein each of the plurality of raised portions further comprise a stop portion, and wherein the stop portion is defined as a flat upstream face that extends radially inward from an interior surface of the rim.

8. The nozzle insert of claim 1 further comprising a plurality of cavities, wherein the cavities are defined by cutouts such that the cavities extend radially inward from an exterior surface of the angled wall.

9. The nozzle insert of claim 1, wherein the orifice wall is cylindrical in shape, and wherein a forwardmost face of the orifice wall defines a flat front face of the nozzle insert.

10. The nozzle insert of claim 1, wherein a gap is defined between the angled wall and the orifice wall.

11. The nozzle insert of claim 10, wherein the gap is disposed upstream of the nozzle orifice and terminates at the intersection between the angled wall and the orifice wall.

12. The nozzle insert of claim 10, wherein the gap defines a swirl chamber, and wherein the swirl chamber is frustoconical in shape.

13. The nozzle insert of claim 12, wherein the orifice wall extends laterally rearward from a forwardmost point of the swirl chamber.

14. The nozzle insert of claim 2, wherein the post is configured to define an actuator fluid passageway of the external actuator.

15. The nozzle insert of claim 4, wherein the body includes a chamfered step between the front portion and the rear portion, and wherein the plurality of ribs terminates forward of the chamfered step.

16. The nozzle insert of claim 4, wherein the plurality of ribs comprises four ribs.

17. The nozzle insert of claim 16, wherein each rib of the plurality of ribs is circumferentially spaced at approximately equal angular intervals.

18. The nozzle insert of claim 17, wherein each rib of the plurality of ribs includes a ramp portion and a spacer portion.

19. The nozzle insert of claim 18, wherein the ramp portion is semispherical.

20. The nozzle insert of claim 7, wherein the plurality of raised portions further comprises a plurality of sloped portions and a level portion, wherein the level portion is disposed between the plurality of sloped portions.

* * * * *